US009409671B2

(12) United States Patent
Lefebvre

(10) Patent No.: US 9,409,671 B2
(45) Date of Patent: Aug. 9, 2016

(54) BASKET ASSEMBLY

(71) Applicant: CASCADES CANADA ULC, St-Bruno (CA)

(72) Inventor: Luc Lefebvre, Laval (CA)

(73) Assignee: CASCADES CANADA ULC, Québec (CA)

( * ) Notice: Subject to any disclaimer, the term of this patent is extended or adjusted under 35 U.S.C. 154(b) by 0 days.

(21) Appl. No.: 14/435,150

(22) PCT Filed: Oct. 12, 2012

(86) PCT No.: PCT/CA2012/050720

§ 371 (c)(1),
(2) Date: Apr. 10, 2015

(87) PCT Pub. No.: WO2014/056068

PCT Pub. Date: Apr. 17, 2014

(65) Prior Publication Data

US 2015/0266609 A1 Sep. 24, 2015

(51) Int. Cl.

| | |
|---|---|
| ***B65D 5/462*** | (2006.01) |
| ***B65D 5/56*** | (2006.01) |
| ***B65D 5/20*** | (2006.01) |
| ***B65D 5/46*** | (2006.01) |

(Continued)

(52) U.S. Cl.

CPC ..... *B65D 5/46192* (2013.01); *B31B 1/00* (2013.01); *B65D 5/2033* (2013.01); *B65D 5/2047* (2013.01); *B65D 5/28* (2013.01); *B65D 5/566* (2013.01); *B31B 2201/9095* (2013.01); *B31B 2217/062* (2013.01); *B31B 2217/084* (2013.01)

(58) Field of Classification Search

CPC ..... B65D 5/46016; B65D 5/46032

See application file for complete search history.

(56) References Cited

U.S. PATENT DOCUMENTS

| | | | |
|---|---|---|---|
| 2,374,366 | A | 4/1945 | Madan |
| 2,660,363 | A | 11/1953 | Trickett et al. |
| 2,675,162 | A | 4/1954 | Higham |

(Continued)

FOREIGN PATENT DOCUMENTS

| | | | |
|---|---|---|---|
| CA | 1000673 | A1 | 11/1976 |
| CA | 1080142 | A1 | 6/1980 |

(Continued)

OTHER PUBLICATIONS

Search Report in International Application No. PCT/CA2012/050720 dated Jul. 9, 2013.

*Primary Examiner* — Gary Elkins

(74) *Attorney, Agent, or Firm* — Marshall, Gerstein & Borun LLP

(57) ABSTRACT

There is provided a basket assembly for making a basket, as well as a blank for making the basket assembly. A support sheet is mounted along a bottom wall of a container portion of the basket, either inside or outside of the container, providing a multi-layered assembly. The innermost layer of the support sheet and the container portion define a cut-out portion corresponding to a handle for the basket, which is nested in the innermost layer of the multi-layered assembly. The handle portion has opposing ends which are mounted to the container and side edges which are separable from the innermost layer, allowing to lift the nested handle away from the bottom of the container and to draw it out to provide the basket with a handle. The gap appearing in the innermost layer is covered by the outer layer of the multi-layered assembly.

24 Claims, 15 Drawing Sheets

(51) Int. Cl.
*B31B 1/00* (2006.01)
*B65D 5/28* (2006.01)

(56) References Cited

U.S. PATENT DOCUMENTS

| | | | | | |
|---|---|---|---|---|---|
| 2,690,289 | A | * | 9/1954 | Claus | B65D 5/46024 229/117.19 |
| 2,753,102 | A | * | 7/1956 | Paige | B65D 5/08 206/499 |
| 2,851,211 | A | * | 9/1958 | Bergstein | B65D 5/46016 229/117.06 |
| 2,918,206 | A | * | 12/1959 | Kleingers, Jr. | B65D 5/46016 229/117.07 |
| 3,094,268 | A | | 6/1963 | Swanson et al. | |
| 3,700,160 | A | | 10/1972 | Farrell | |
| 3,929,274 | A | * | 12/1975 | Akkerman | B65D 5/46192 206/139 |
| 3,955,745 | A | * | 5/1976 | Forrer | B65D 71/0007 206/162 |
| 4,034,907 | A | | 7/1977 | Engdahl | |
| 4,058,248 | A | | 11/1977 | McArdle | |
| 4,126,265 | A | | 11/1978 | Holmes | |
| 4,742,915 | A | | 5/1988 | Ringer | |
| 4,763,833 | A | * | 8/1988 | Stoll | B65D 5/2047 217/125 |
| 5,538,130 | A | | 7/1996 | Harrelson | |
| 5,855,316 | A | | 1/1999 | Spivey | |
| 5,897,051 | A | | 4/1999 | Tessier et al. | |
| 7,143,931 | B2 | * | 12/2006 | Johnson | B65D 5/0245 229/117.14 |
| 8,020,695 | B2 | | 9/2011 | Brand | |
| 8,191,761 | B2 | * | 6/2012 | Brand | B65D 5/46192 229/117.12 |
| 2003/0230499 | A1 | | 12/2003 | Wagner | |
| 2004/0182859 | A1 | | 9/2004 | Pai | |
| 2008/0210581 | A1 | | 9/2008 | Brand | |
| 2008/0272014 | A1 | | 11/2008 | Taets | |
| 2009/0121001 | A1 | | 5/2009 | Miquel Perez et al. | |
| 2009/0314786 | A1 | | 12/2009 | Cardinale | |
| 2011/0290809 | A1 | | 12/2011 | Liebowitz et al. | |

FOREIGN PATENT DOCUMENTS

| | | | |
|---|---|---|---|
| EP | 0919480 | A2 | 6/1999 |
| EP | 1262417 | A2 | 12/2002 |
| GB | 2111949 | A | 7/1983 |

* cited by examiner

BASKET ASSEMBLY

FIELD OF THE INVENTION

The present invention relates to a basket assembly. More particularly, the present invention relates to a basket assembly for making a basket, to a basket made from the basket assembly, to a blank for making the basket assembly, to a method of making the blank, to a method of making a basket assembly from the blank, as well as to a method of making a basket from the basket assembly.

BACKGROUND OF THE INVENTION

Baskets are commonly used for shipping and selling goods such as fruits and vegetables in markets, as well as other products. Conventional baskets are made by assembling a blank forming a tray-shaped container and attaching thereto a separately provided handle component. For example, a plastic handle may be mounted onto the container by fitting inserts of the handle into corresponding slots of the container. Other baskets have a wooden handle which is permanently stitched to the container. Such baskets usually have a container component made of wood, plastic or cardboard.

Moreover, conventional baskets are usually provided with rigid handles (for example, plastic, wood), and are therefor relatively difficult to stack or to store in an efficient manner. Therefore, the basket components (i.e. the container and the handle) are usually delivered separately to a customer, who must then assemble the components to make the baskets. This step requires time, equipment and labor.

Furthermore, in order to dispose of baskets having a container component made of a cardboard material for recycling, the basket must be disassembled or dismantled in order to properly dispose of each component separately. Such a task also requires labor and presents handling problems in some cases, discouraging consumers from recycling the baskets.

Therefore, there is a need for a pre-assembled basket which is convenient for shipping and/or storage, and which is also easy to dispose of for recycling.

Known to the Applicant is U.S. Pat. No. 1,000,673 (AKKERMAN, Allardus A.) granted to Domtar Limited on Nov. 30, 1976. A single paperboard blank is folded into a container for a basket, having a bottom wall and side walls. A handle is formed by a band running across the bottom wall and part way up the side walls. The band is pulled upward to provide the handle, leaving an opening in the container of the basket. Thus the basket is provided with a handle extending integrally from the bottom of the basket and avoids the necessity of assembling a handle having been provided separately.

The basket of AKKERMAN nevertheless presents a number of drawbacks. Namely but not limitedly, the handle leaves a fairly large opening in the bottom of the basket. The contents of the basket must be relatively large in relation to that opening or specially oriented to avoid falling in the bottom hole left behind by the handle.

Hence, in light of the aforementioned, there is a need for an improved system which, by virtue of its design and components, would be able to overcome some of the above-discussed prior art concerns.

SUMMARY OF THE INVENTION

The object of the present invention is to provide a basket assembly and system which, by virtue of its design and components, satisfies some of the above-mentioned needs and is thus an improvement over other related packages and/or packaging methods known in the prior art.

In accordance with the present invention, the above mentioned object is achieved, as will be easily understood, by a basket assembly for making a basket, the basket assembly comprising:

- a container having a bottom wall, a containment area, and an inner lane extending across the containment area of the container;
- a support sheet mountable along the bottom wall of the container so as to provide a multi-layered assembly spanning over a section of the inner lane; and
- a handle portion extending within the inner lane and being defined from a cut-out portion of an innermost layer of the multi-layered assembly, the handle portion having a pair of opposing ends mountable to the container and a pair of side edges extending between the opposing ends, the side edges being separable from the innermost layer in order to operate the handle portion between a nested configuration wherein the handle portion is substantially nested within the multi-layered assembly, and a drawn-out configuration wherein the side edges of the handle portion are drawn away from said multi-layered assembly to provide the container of the basket with a handle.

According to another aspect of the present invention, there is also provided a blank for making a basket assembly, the blank comprising:

- a container portion being operable from a planar configuration wherein the container portion extends substantially along a given plane and an assembled configuration wherein the container portion is shaped and configured to provide a container for a basket, having a containment area, a bottom wall, and an inner lane extending across the containment area of the container;
- a support sheet mountable on the container portion to cover the bottom wall of the container so as to provide a multi-layered assembly spanning over a section of the inner lane; and
- a handle portion extending within the inner lane and being defined from a cut-out portion of an innermost layer of the multi-layered assembly, the handle portion having a pair of opposing ends mountable to the container portion and a pair of side edges extending between the opposing ends, the side edges being separable from the innermost layer in order to operate the handle portion between a nested configuration wherein the handle portion is substantially nested within the multi-layered assembly, and a drawn-out configuration wherein the side edges of the handle portion are drawn away from said multi-layered assembly, when the container portion is operated in the assembled configuration, to provide the container of the basket with a handle.

Preferably, the container (or the "container portion" in the case of the blank) and the support sheet, both comprise a cellulose fiber material, and preferably the container is made of a corrugated containerboard material, and the support sheet is made of a cardboard. Alternatively, the container is made of a corrugated containerboard material, and the support sheet is made of or contains a translucent plastic film.

According to yet another aspect of the present invention, there is also provided a method of making a blank to be assembled into a basket assembly, the method comprising the steps of:

a) configuring a container portion to be operable from a planar configuration wherein the container portion extends substantially along a given plane and an assembled configuration wherein the container portion is shaped and configured to provide a container for a basket, having a containment area, a bottom wall and an inner lane extending across the containment area of the container;

b) mounting a support sheet on the container portion to cover the bottom wall of the container, so as to provide a multi-layered assembly spanning over a section of the inner lane; and c) defining a handle portion from a cut-out portion of an innermost layer of the multi-layered assembly within the inner lane, the handle portion having a pair of opposing ends mountable to the container portion and a pair of side edges extending between the opposing ends, the side edges being separable from the innermost layer in order to operate the handle portion between a nested configuration wherein the handle portion is substantially nested within the multi-layered assembly, and a drawn-out configuration wherein the side edges of the handle portion are drawn away from said multi-layered assembly, when the container portion is operated in the assembled configuration, to provide the container of the basket with a handle.

It is to be understood that the defining of the handle portion in step (c) may be performed prior to the mounting of step (b).

Still according to another aspect of the present invention, there is also provided a method of making a basket assembly from a blank, wherein the blank comprises:

a container portion being provided in a planar configuration wherein the container portion extends substantially along a given plane, the container portion being operable toward an assembled configuration wherein the container portion is shaped to provide a container for a basket, having a bottom wall, a containment area, and an inner lane extending across the containment area of the container;

a support sheet mounted on the bottom wall of the container portion to provide a multi-layered assembly spanning over a section of the inner lane; and a handle portion extending within the inner lane and being defined from a cut-out portion of an innermost layer of the multi-layered assembly, the handle portion having a pair of opposing ends mounted to the container portion and a pair of side edges extending between the opposing ends, the side edges being separable from the innermost layer, the method comprising the step of:

a) operating the container portion from said planar configuration to said assembled configuration to form said basket assembly (110), wherein the handle portion (128) is substantially nested within the multi-layered assembly (124) and is further operable toward a drawn-out configuration wherein the side edges (138, 140) of the handle portion (128) are drawn away from the multi-layered assembly (124), when the container portion (113) is operated in the assembled configuration, to provide the container (114) of the basket (112) with a handle (142).

Still according to another aspect of the present invention, there is also provided a method of making a basket from a basket assembly, wherein the basket assembly comprises:

a container having a containment area, a bottom wall, and an inner lane extending across the containment area of the container;

a support sheet mounted along a bottom wall of the container so as to provide a multi-layered assembly spanning over a section of the inner lane; and a handle portion extending within the inner lane and being defined from a cut-out portion of an innermost layer of the multi-layered assembly, the handle portion having a pair of opposing ends mounted to the container and a pair of side edges extending between the opposing ends, the side edges being separable from the innermost layer, the handle portion being substantially nested within the multi-layered assembly, the method comprising the step of:

a) drawing the side edges of the handle portion away from the innermost layer of the container to operate the handle portion toward a drawn-out configuration providing the container of the basket with a handle.

Still according to another aspect of the present invention, there is also provided a basket assembly comprising:

a container having a bottom wall, a containment area, and an inner lane extending across the containment area of the container;

a support sheet mounted along the bottom wall of the container so as to provide a multi-layered assembly spanning over a section of the inner lane; and a handle portion extending within the inner lane and being defined from at least a portion of an innermost layer of the multi-layered assembly and extending integrally from said innermost layer, the handle portion having a pair of opposing ends to the container and a pair of side edges extending between the opposing ends, the side edges being free in order to operate the handle portion between a nested configuration wherein the handle portion is substantially nested within the container, and a drawn-out configuration wherein the side edges of the handle portion are drawn away from said multi-layered assembly to provide the container of the basket with a handle.

Still according to another aspect of the present invention, there is also provided a basket comprising:

a container having a bottom wall, a containment area, and an inner lane extending across the containment area of the container;

a support sheet mounted along the bottom wall of the container so as to provide a multi-layered assembly spanning over a section of the inner lane; and a handle extending in alignment with the inner lane and being defined from a cut-out portion of an innermost layer of the multi-layered assembly, the handle having a pair of opposing ends mounted to the container and a pair of side edges extending between the opposing ends, the side edges being separated from the innermost layer in order to operate the handle portion between a nested configuration wherein the handle portion is substantially nested within the multi-layered assembly, and a drawn-out configuration wherein the side edges of the handle portion are drawn away from said multi-layered assembly to provide the container of the basket with a handle.

In the context of the present invention, the term "container" refers to a receptacle of a basket, capable of holding or "containing" an object. The container refers to a fully shaped container or pre-assembled container. For example, the "container", in the context of the present invention, may refer to a fully assembled and erected container, or it may be collapsed. The "container" may also be partially assembled, according to embodiments of the present invention, in an erected or collapsed configuration. Generally, the "container portion" refers to the portion of the blank which when assembled becomes the container of the basket. It is to be understood that in the context of the present description, the terms "container" and "container portion" may be used interchangeably.

In the context of the present invention, the term "containment area" refers to the space delimited by walls of the container and, as the case may be, by a rim of the container.

The "inner lane" is an area crossing the containment area and extending along an inner surface of the container. The inner lane generally defines the area of the multi-layered assembly corresponding to the handle portion. It is to be understood that the inner lane may be substantially linear or it be non-linear, in the context of the present description. It may also have a constant width or an irregular width. Indeed, the inner lane may come in different shapes and sizes.

The support sheet may be mounted on an inner surface and/or outer surface of the "bottom wall", as can be understood by the skilled reader, in the context of the present invention. Furthermore, the support sheet may be mounted on a portion of the bottom wall, and may further extend beyond the bottom wall, as will be better understood in light of the appended drawings and the detailed description of preferred embodiments following further below.

The "multi-layered assembly", in the context of the present invention, refers to the superposition of the container (or container portion) and the support sheet. The "multi-layered assembly" covers a "section" (i.e. a length, portion, segment, etc.) of the inner lane and preferably spans beyond the inner lane. The multi-layered assembly thus comprises at least two layers, namely the container (or container portion) and the support sheet. It is to be understood that the other layers may be provided within or adjacent the multi-layered assembly as may be understood by the person skilled in the art.

The "innermost layer" of the multi-layered assembly corresponds to the layer which is the most superficial of the layers inside the container. The innermost layer generally provides the inner surface for the container in the area where the container (or container portion) and the support sheet are superposed. The innermost layer may be provided by the container if the support sheet is mounted on the outer side of the container. Alternatively, the innermost layer may be provided by the support sheet if the support sheet is mounted on an inner side of the container.

The "handle portion" which is defined from a "cut-out portion" of an innermost layer of the multi-layered assembly, is delimited within the innermost layer. Preferably, the ends of the handle portion extend integrally from the innermost layer (or it is integrally connected to the innermost layer). The side edges are "separable from the innermost layer" in that the side edges may be moved apart from the innermost layer. Each of the side edges may be pre-cut from the innermost layer or provided with another form of severance line (for example one or more slit(s), perforated line(s), score line(s), crease(s), fold line(s), and/or the like) in order to facilitate separating the handle portion along its side edges from the innermost layer.

In the context of the present invention, "basket assembly" is a partially assembled or pre-assembled fabrication from which a basket may be made. A basket assembly may be for example a pre-assembled collapsed basket, which can be readily erected to form a basket with handle. Alternatively, the basket assembly may comprise unattached or disassembled components which may be readily assembled to form the basket.

Preferably, the afore-mentioned basket assembly, blank and/or components thereof are made of a cellulose fiber material, for example, containerboard, corrugated material, a folding carton, boxboard, paperboard, paper material, cardboard, and/or the like, which may include virgin material, recycled material, molded pulp, etc. and may be multi-layered, laminated, etc.

The objects, advantages and features of the present invention will become more apparent upon reading of the following non-restrictive description of preferred embodiments thereof, given for the purpose of exemplification only, with reference to the accompanying drawings.

DETAILED DESCRIPTION OF PREFERRED EMBODIMENTS OF THE INVENTION

In the following description, the same numerical references refer to similar elements. The embodiments, geometrical configurations, materials mentioned and/or dimensions shown in the figures or described in the present description are preferred embodiments only, given for exemplification purposes only.

Although the preferred embodiment of the present invention as illustrated in the accompanying drawings comprises components such as, perforations along the side edges of the handle portion, finger holes, a push hole, air holes, side walls, end walls, angular walls, a window, flaps, a reinforcing strip, and although the preferred embodiment of the basket assembly and/or blank and corresponding parts thereof consists of certain geometrical configurations as explained and illustrated herein, not all of these components and geometries are essential to the invention and thus should not be taken in their restrictive sense, i.e. should not be taken as to limit the scope of the present invention. It is to be understood, as also apparent to a person skilled in the art, that other suitable components and cooperations thereinbetween, as well as other suitable geometrical configurations may be used for the basket assembly and/or blank in accordance with the present invention, as will be briefly explained herein and as can be easily inferred herefrom, by a person skilled in the art, without departing from the scope of the invention.

Also, although the term "container" is generally used when referring to the basket assembly or the basket and the term "container portion" is generally used when referring to the blank, it is to be understood that these terms may be used interchangeably in the context of the present description. The same applies for "handle" and "handle portion", as well as "rim" and "rim portion", for example.

Furthermore, the order of the steps of the method described herein should not be taken as to limit the scope of the invention, as the sequence of the steps may vary in a number of ways, without affecting the scope or working of the invention, as can also be understood.

Broadly described, there is provided a pre-assembled basket provided with a nested handle, which can be pulled out in order to make a basket.

Figure 1:
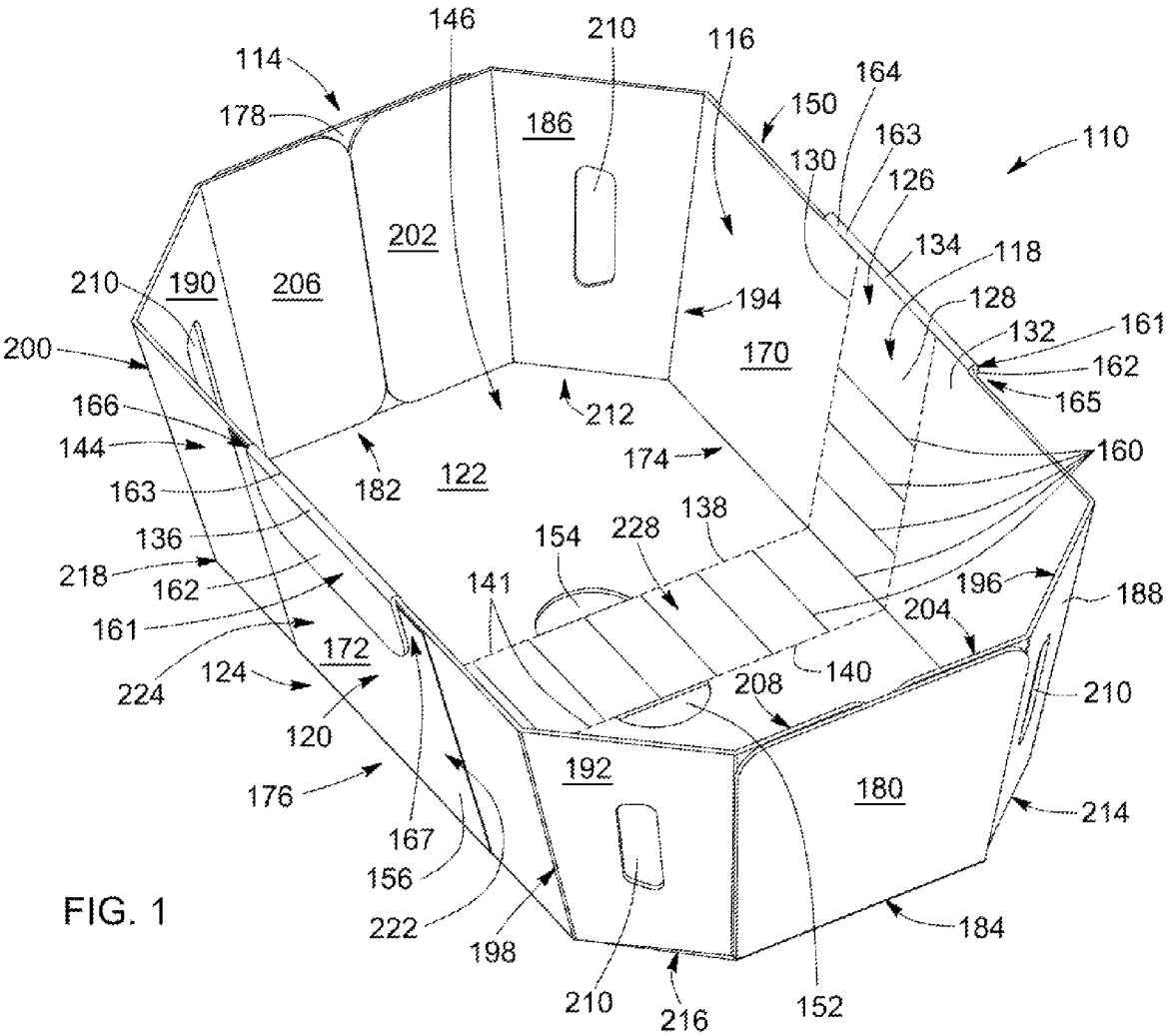
FIG. 1 is a perspective view of a basket assembly, according to a first embodiment of the present invention, the basket assembly having a container, a support sheet mounted on an outer surface of the container, and a handle being formed integrally within the container, the handle being shown in a nested configuration.
Figure 2:
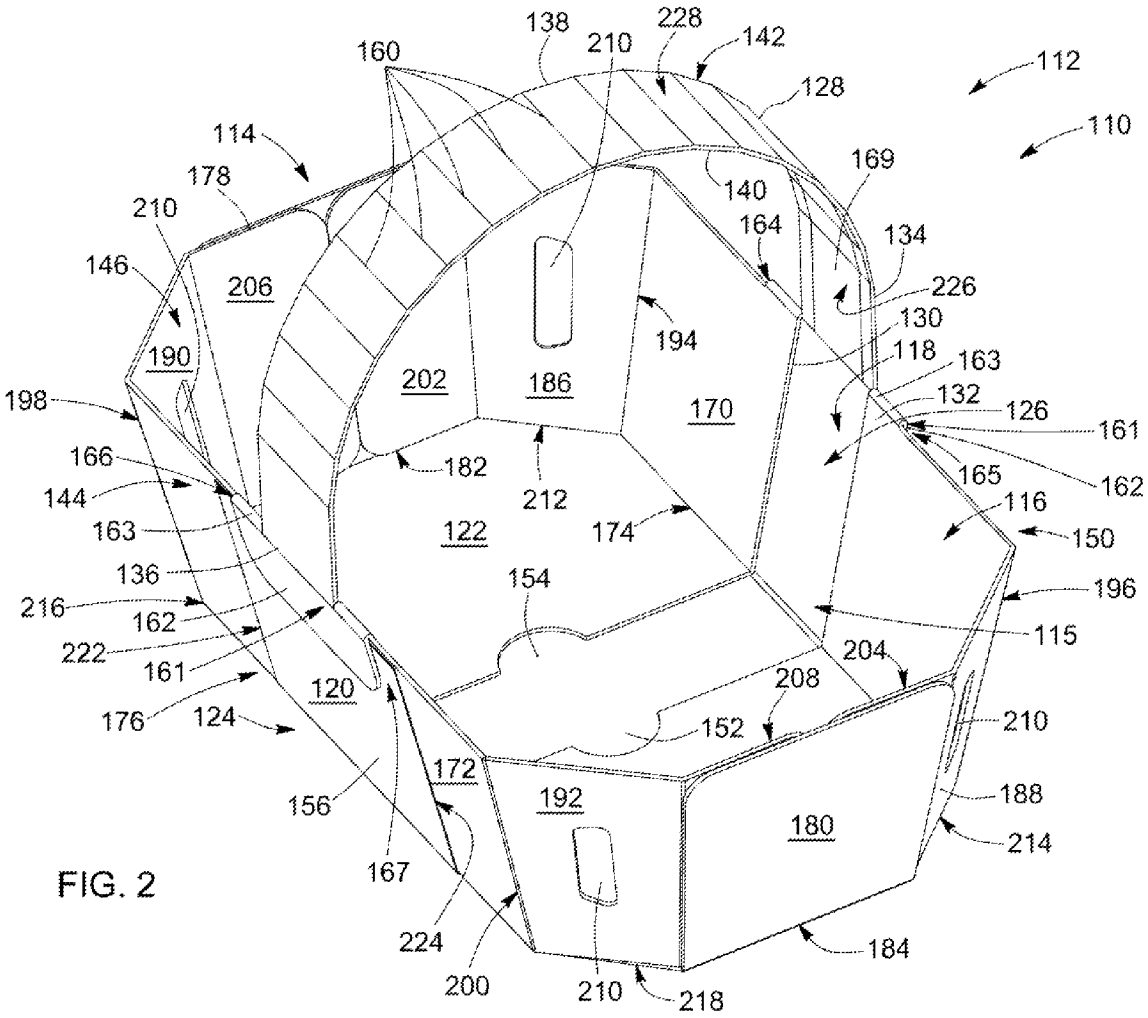
FIG. 2 is a perspective view of a basket made from the basket assembly of FIG. 1, the handle being shown in a drawn-out configuration.
Figure 3:
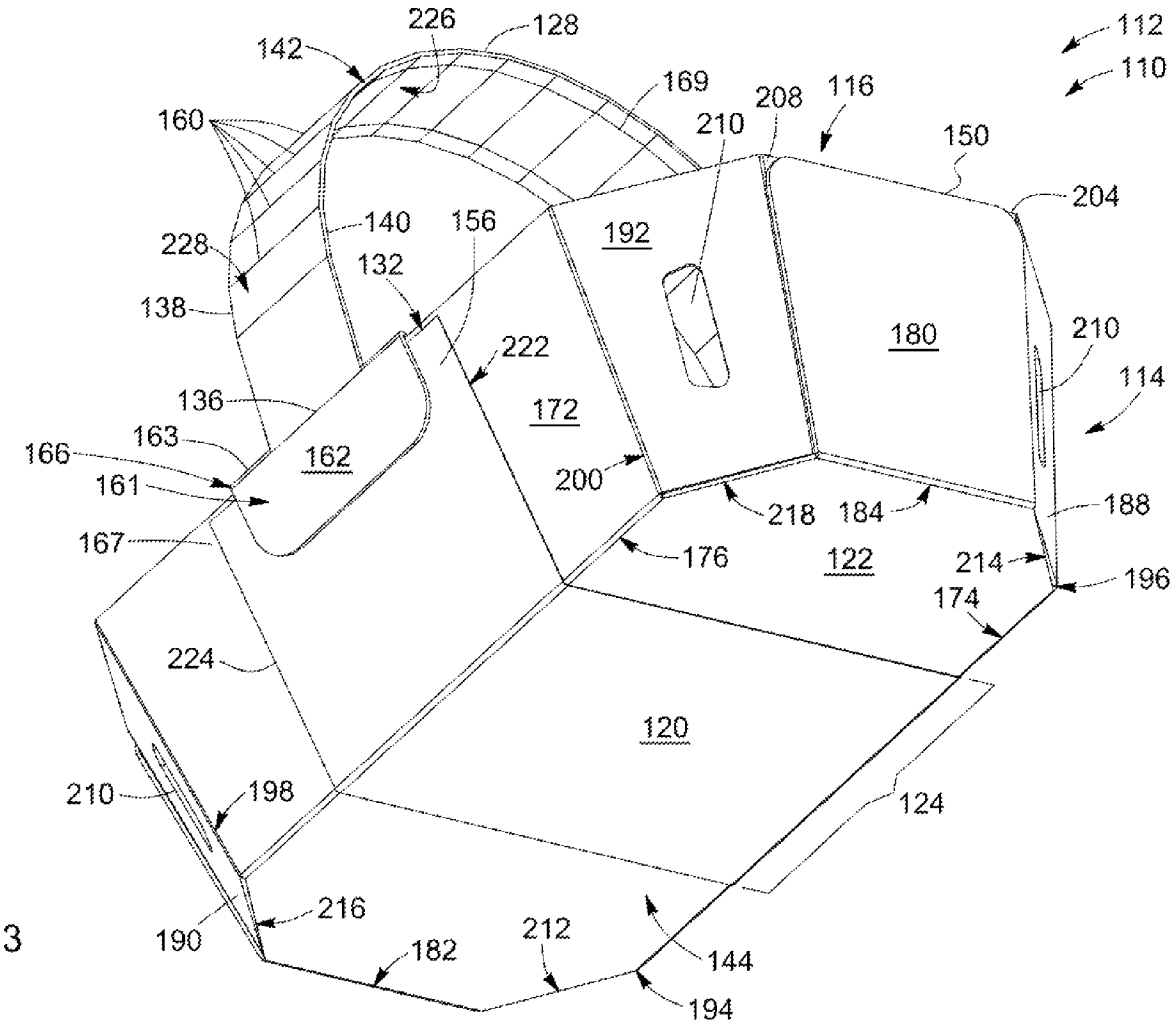
FIG. 3 is a lower perspective view of the basket assembly of FIG. 1.

Preferably and as better illustrated in FIGS. 1, 2 and 3, there is provided a basket assembly (110) for making a basket (112). The basket assembly (110) comprises a container (114) having a bottom wall (122), a containment area (116), and an inner lane (118) extending across the containment area (116) of the container (114) and intersecting the bottom wall (122). The basket assembly (110) further comprises a support sheet (120) mounted along the bottom wall (122) of the container (114) so as to provide a multi-layered assembly (124) spanning over a section (126) of the inner lane (118). The basket assembly (110) further comprises a handle portion (128) extending within the inner lane (118) and being defined from a cut-out portion (130) of an innermost layer (132) of the multi-layered assembly (124). The handle portion (128) has a pair of opposing ends (134, 136) mounted to the container (114) and a pair of side edges (138, 140) extending between the opposing ends (134). The side edges (138, 140) are separable from the innermost layer (132) in order to operate the handle portion (128) between a nested configuration, as shown in FIG. 1, wherein the handle portion (128) is substantially nested within the multi-layered assembly (124), and a drawn-out configuration, as shown in FIGS. 2 and 3, wherein the side edges (138, 140) of the handle portion (128) are drawn away from the multi-layered assembly (124) to provide the container (114) of the basket (112) with a handle (142).

The container (114) comprises an inner surface (146) generally facing the containment area (116), and an outer surface (144), opposite the inner surface (146), generally facing the exterior of the container (114). In the first embodiment of the invention, better shown in FIGS. 1 to 5D, the support sheet (120) is mounted on the outer surface (144) of the container (114).

Figure 4A:
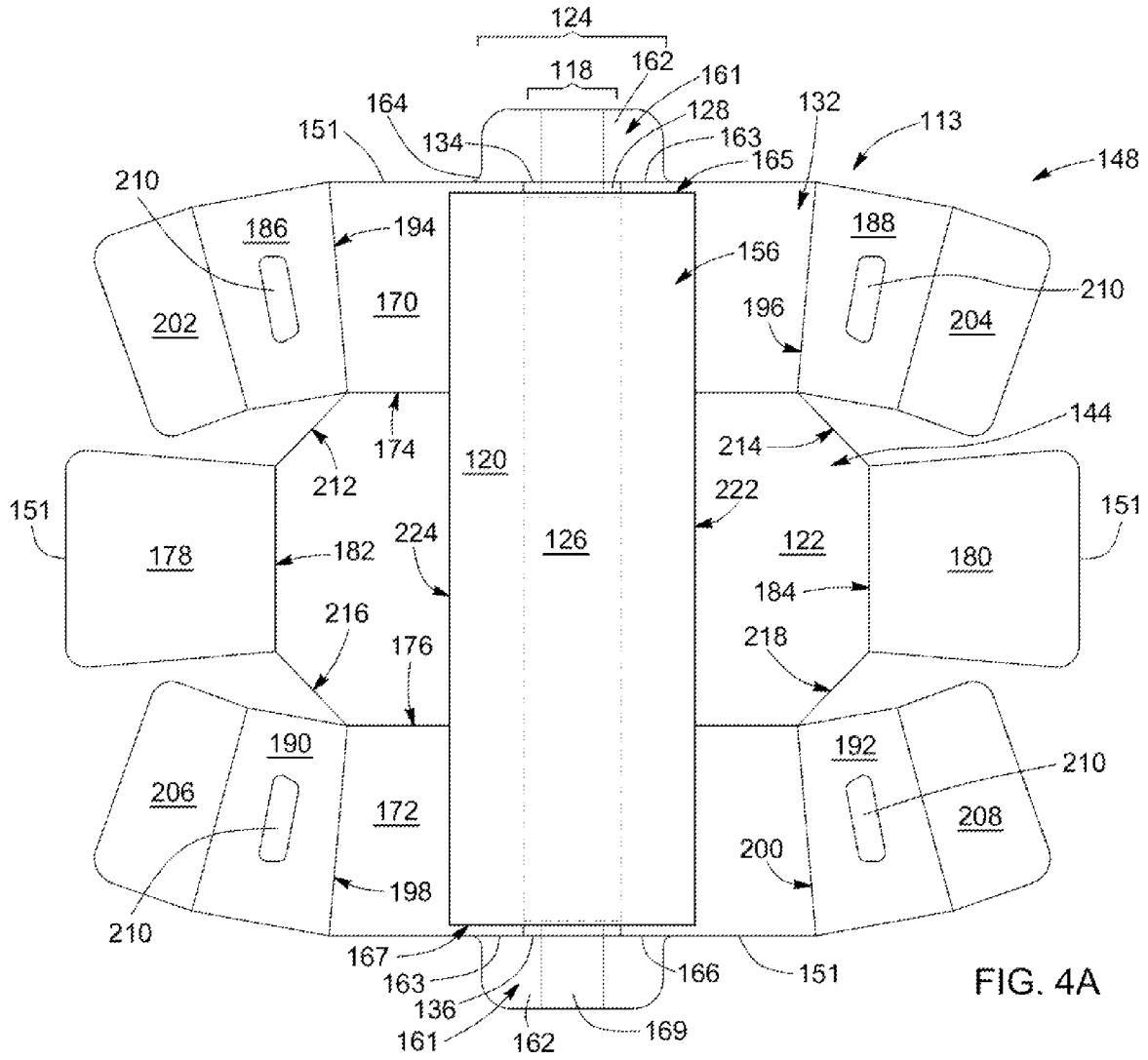
FIG. 4A is a bottom plan view of a blank for making the basket assembly shown in FIG. 1, the blank having a container portion and a support sheet, the bottom plan view showing an outer side of the container portion.
Figure 4C:
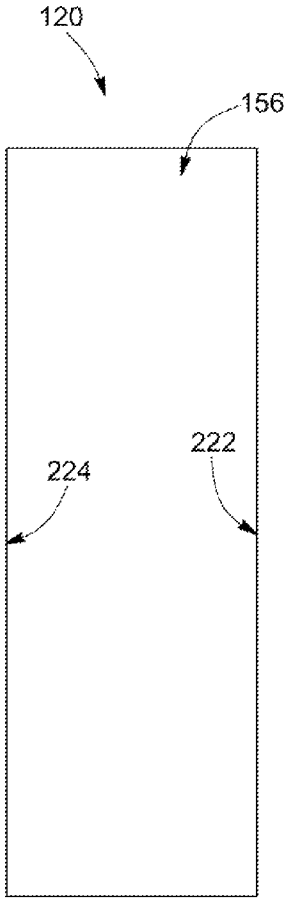
FIG. 4C is a bottom plan view of a support sheet to be mounted on the blank shown in FIG. 4B.
Figure 4B:
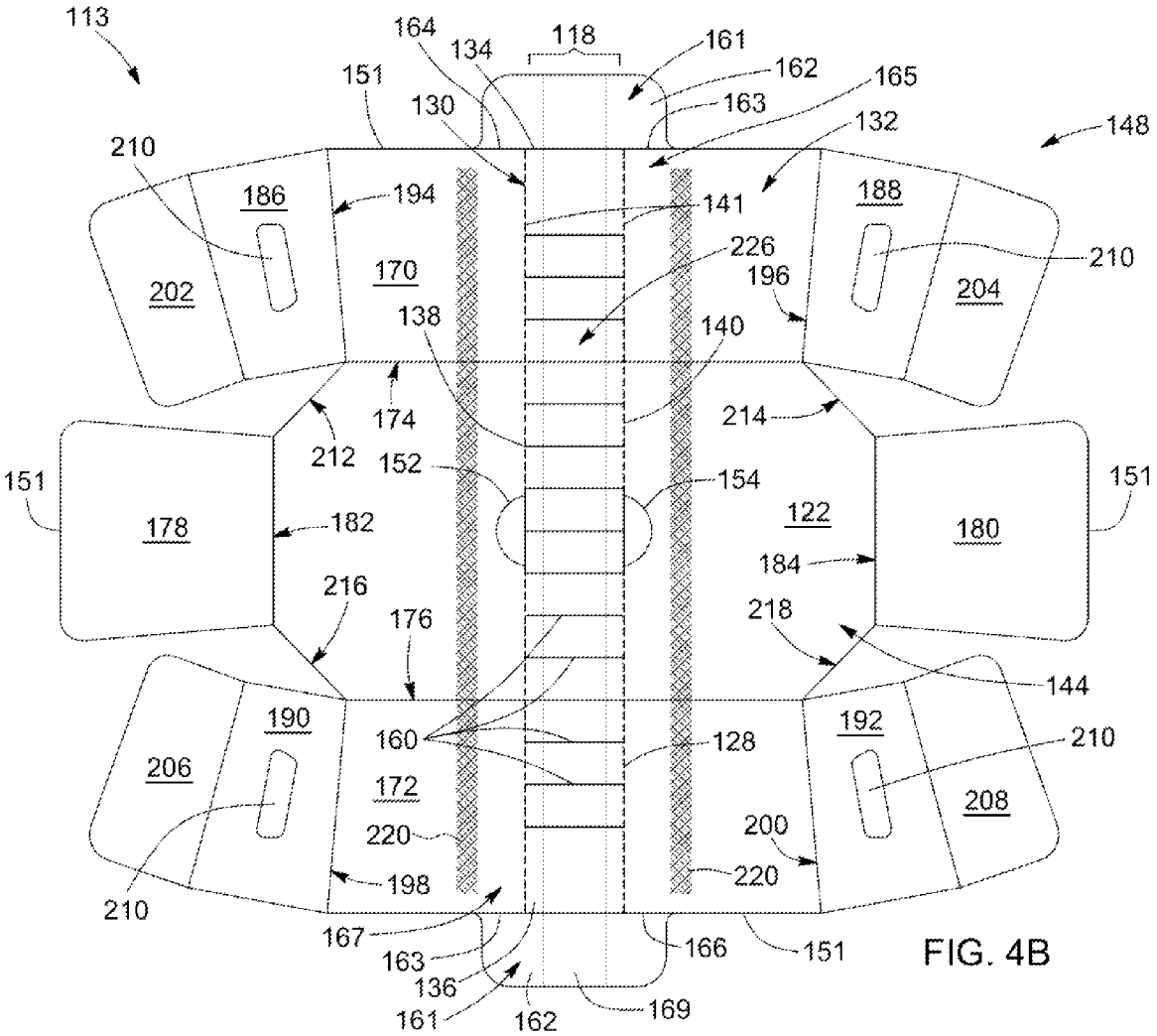
FIG. 4B is a bottom plan view of the container portion of the blank shown in FIG. 4A, the blank being shown with adherent placed on areas corresponding to edges of the support sheet shown in FIG. 4A.

FIG. 4A to 4C show a blank (148) for making the basket assembly shown in FIGS. 1 to 3, and the components of the blank (148), namely the container portion (113) and the support sheet (120), as will be better explained further below.

FIG. 5A to 5D show steps for making the blank (148), in accordance with the first embodiment of the invention, as will be better explained further below.

Figure 6A:
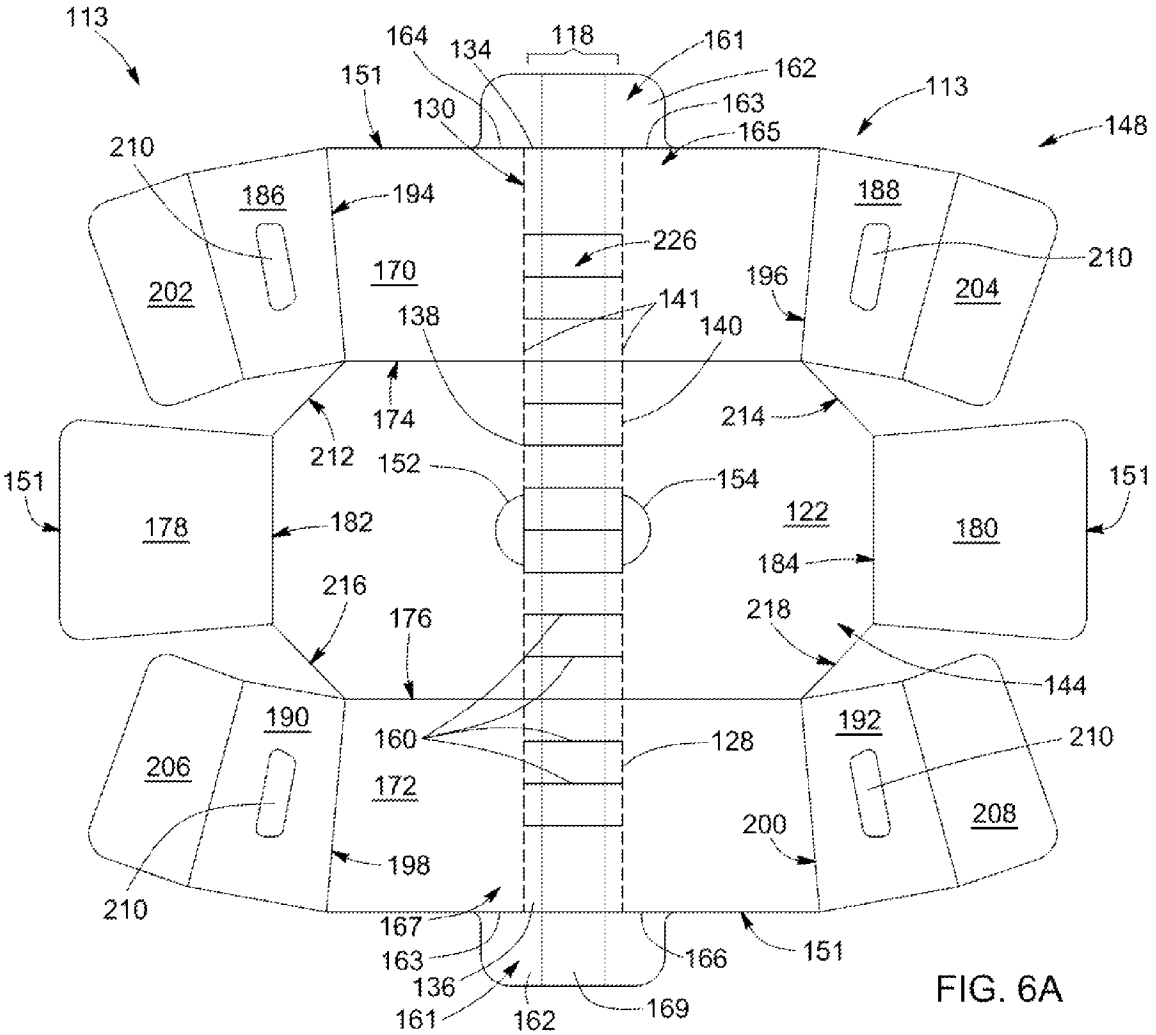
FIG. 6A is a schematic bottom plan view of a container portion of the blank for making the basket shown in FIG. 1, the bottom plan view showing the outer surface of the container portion.
Figure 6C:
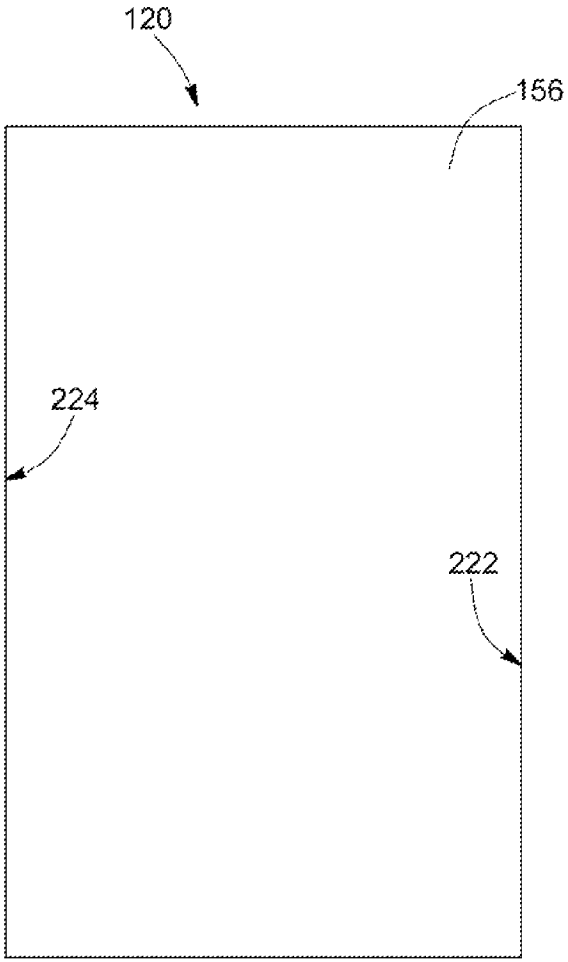
FIG. 6C is a top plan view of a support sheet to be mounted onto the blank shown in FIG. 6A, in accordance with another embodiment of the present invention wherein the support sheet is relatively broad.
Figure 6B:
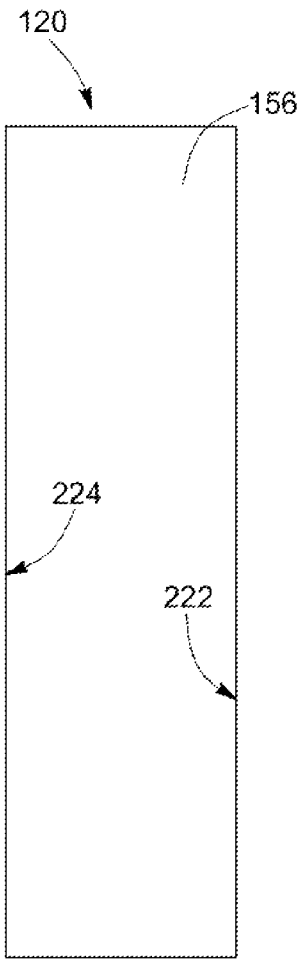
FIG. 6B is a top plan view of a support sheet to be mounted onto the blank shown in FIG. 6A, in accordance with an embodiment of the present invention wherein the support sheet is relatively narrow.

FIG. 6A to 6C exemplify components of a blank (148), in accordance with alternate embodiments of the invention, as will be better explained further below.

Referring back to FIGS. 1 to 5D, the innermost layer (132) is provided by the container (114), and when the handle portion is lifted toward its drawn-out configuration, a gap (115) appears in the container (114). The gap (115) is advantageously covered by the support sheet (120). The support sheet (120) thus prevents contents of the container (114) to drop through the gap (115) and further provides structural rigidity to the bottom wall (122).

Figure 7:
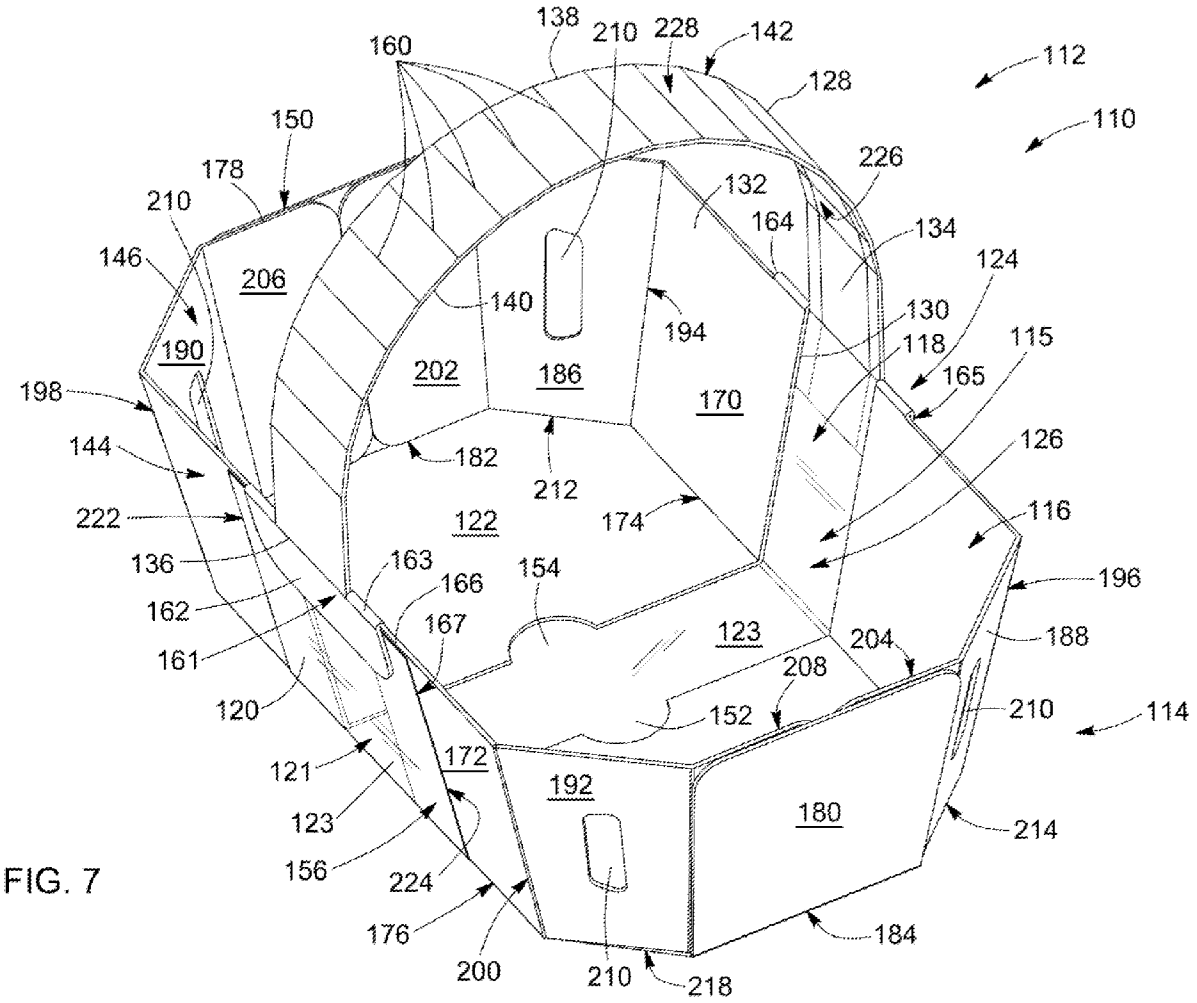
FIG. 7 is a perspective view of a basket made from a basket assembly in accordance with a second embodiment of the present invention, the basket assembly having a container, a support sheet mounted on an outer surface of the container, and a handle being formed integrally within the container having been drawn into a drawn-out configuration, the support sheet being made of a translucent material.

A second embodiment, illustrated in FIG. 7, is a variant of the first embodiment, where the support sheet (120) comprises a translucent material (121), as will be described further below. Advantageously, the translucent material (121) covering the gap (115) which appears in the container (114) when the handle portion (128) is lifted away from the container (114), provides the basket with a window (123) to view the contents of the basket (112).

In accordance with a third embodiment, the support sheet (120) is mounted on the inner surface (146), and the innermost layer (132) is therefore provided by the support sheet (120). This third embodiment will be described further below with reference to FIGS. 8 to 11C.

In accordance with the first embodiment and third embodiment, the container (114) and the support sheet (120), both comprise a cellulose fiber material. More particularly, the container (114) is made of a corrugated containerboard material, and the support sheet (120) is made of a cardboard. Thus, the handle portion is preferably made of the same material as whichever of the container (114) and the support sheet (120) corresponds to the innermost layer (i.e. corrugated containerboard material in the first embodiment and cardboard in the third embodiment).

In accordance with the second embodiment, the container (114) is made of a corrugated containerboard material, and the support sheet (120) is made of or contains a translucent plastic film. Thus, the handle is made of corrugated containerboard material, i.e. same as the innermost layer which is provided by the container (114).

Preferably, the handle portion (128) and the innermost layer (132) of the multi-layered assembly (124) are made of the same or similar composition since the handle portion (128) preferably extends integrally from the innermost layer (132). However, in alternative embodiments, the handle portion (128) and/or other portions of the innermost layer (132) may have different compositions. Preferably, the container (114) and the support sheet (120) are made of a same or similar material for easier disposal. Still preferably, all the components of the basket assembly (110) are made of a similar material.

It is to be understood also, that any of the components, including the container, the support sheet, the handle portion, etc. may be made of any suitable material and composition. For example, one or more of the components may be multi-layered, as can be readily understood by a person skilled in the art.

Referring back to the first embodiment, illustrated in FIGS. 1 to 3, the opposing ends (134, 136) of the handle portion (128) coincide with a rim (150) of the container (114). The same configuration applies to the second and third embodiments, as apparent in FIGS. 7 and 8.

Figure 8:
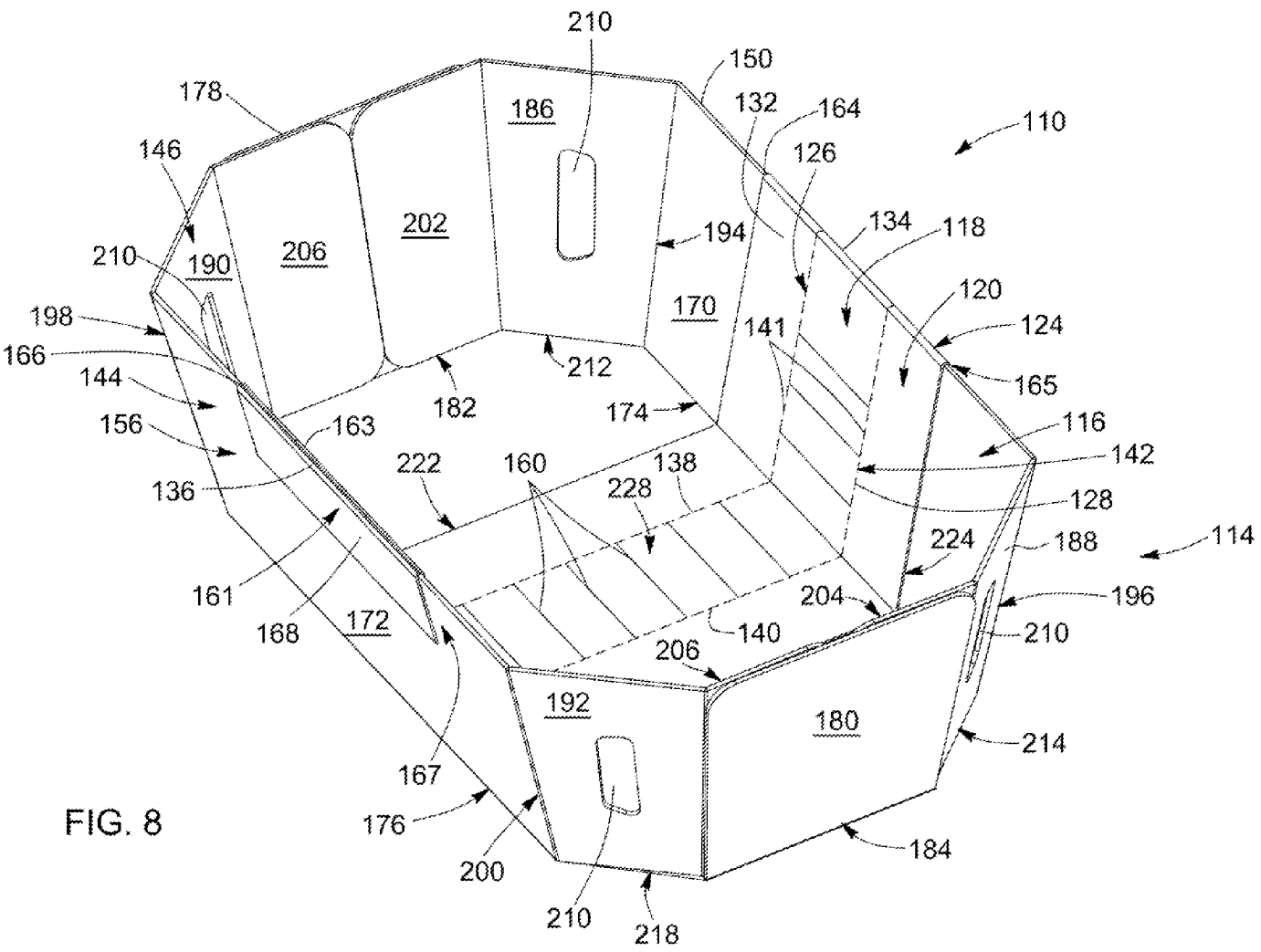
FIG. 8 is a perspective view of a basket assembly, in accordance with a third embodiment of the present invention, the basket assembly having a container, a support sheet mounted on an inner surface of the container, and a handle being formed integrally within the support sheet, the handle being shown in a nested configuration, the support assembly being made of a translucent material.

As shown in FIGS. 1 and 2, the handle portion (128) is delimited along each of the side edges (138, 140) by a perforation line (141) detacheably connecting the side edges (138, 140) to the innermost layer (132) of the multi-layered assembly (124). The same configuration applies to the second and third embodiment, as illustrated in FIGS. 7 and 8, respectively.

In accordance with an alternative embodiment, the handle portion (128) is cut from the innermost layer (132), along each of the side edges (138, 140). It is to be understood that the side edges may be partially connected in any suitable way to the innermost layer, so long as they are detachable therefrom in order to operate the handle portion (128) from the nested configuration toward the drawn-out configuration.

Preferably, the handle portion is an elongated component, in order to span centrally across the basket and allow a hand to hold the handle similarly to a handle of a conventional basket. It is to be understood however that the handle portion may have any suitable shape, configuration and position, as can be understood, provided that it suitably supports the container to maintain the content of the basket in the containment area, when the handle is drawn-out. Also, the handle portion may be substantially linear or it may be non-linear. It may have a constant width or an irregular width. The handle portion may extend from one side to another, from one end to another, from corner to corner, from bottom corner to top corner, etc. Also, there may be provided more than one handle. For example, one handle may be located near one end of the basket and while another is mounted near another end. In such a case, there may be a single support sheet extending to "cover" both handle portions or each handle may be aligned to a separate support sheet.

As shown in FIGS. 1 and 2, and as also apparent in the corresponding blank when referring to FIGS. 4B and 5A to 5D, the innermost layer (132), i.e. the container (114) or container portion (113) of the multi-layered assembly (124) comprises a finger hole (152, 154) adjacent the handle portion (128), along at each of the side edges (138, 140) to allow gripping the handle portion (128) in order to draw it out toward the drawn-out configuration shown in FIG. 2. The finger holes (152, 154) have a semi-circular shape.

The second embodiment also comprises similar semi-circular finger holes (152, 154), adjacent both side edges (138, 140) of the handle portion (128), as illustrated in FIG. 7.

In accordance with an alternative embodiment, the finger holes (152, 154) extend across the multi-layered assembly (124), such that the multi-layered assembly (124) comprises a finger hole (152, 154) adjacent the handle portion (128), along at least one of the side edges (138, 140) to allow gripping the handle portion (128) toward the drawn-out configuration.

Figure 9:
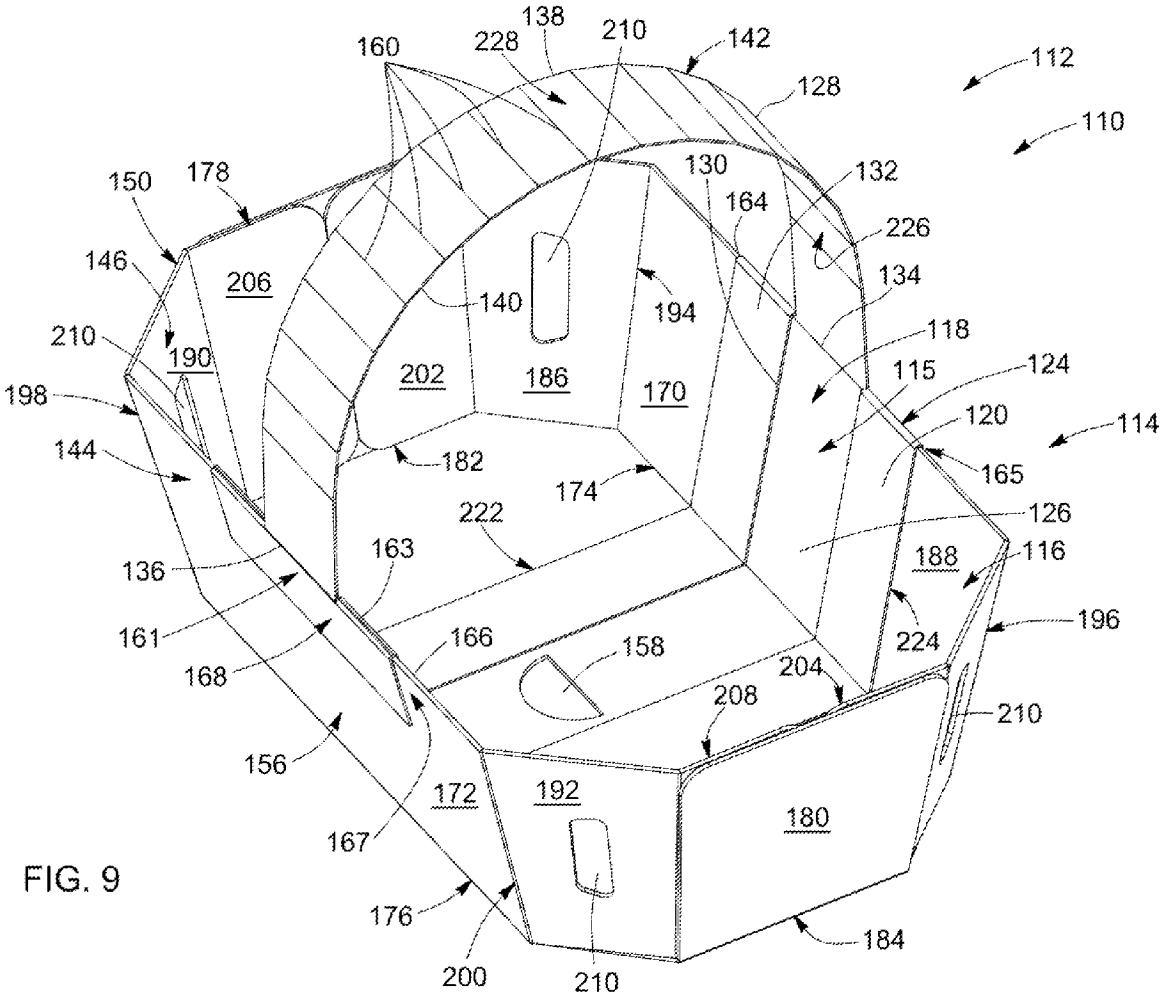
FIG. 9 is a perspective view of a basket made from the basket assembly of FIG. 8, the handle being shown in a drawn-out configuration.
Figure 10:
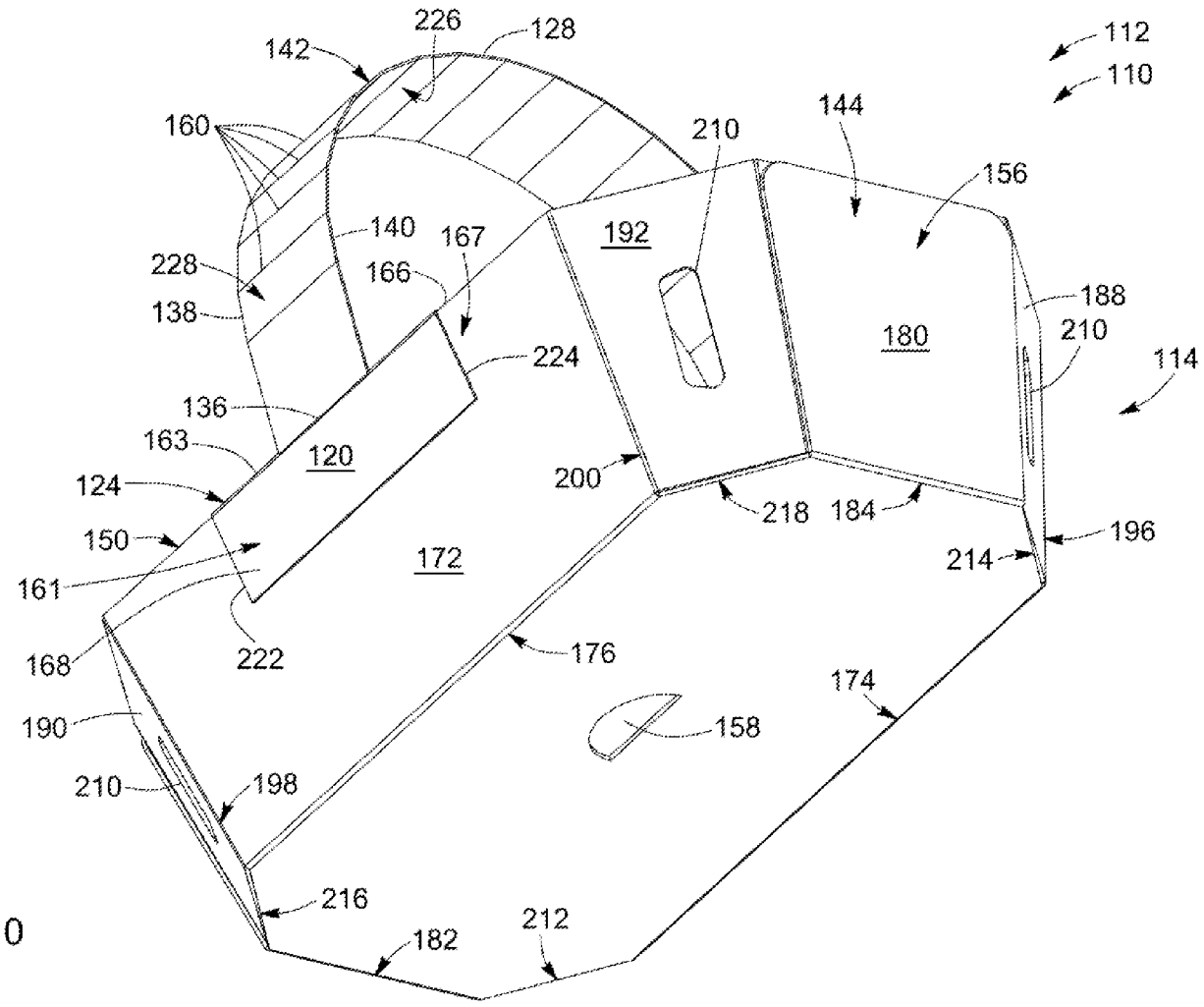
FIG. 10 is a bottom perspective view of the basket assembly of FIG. 8.
Figure 11A:
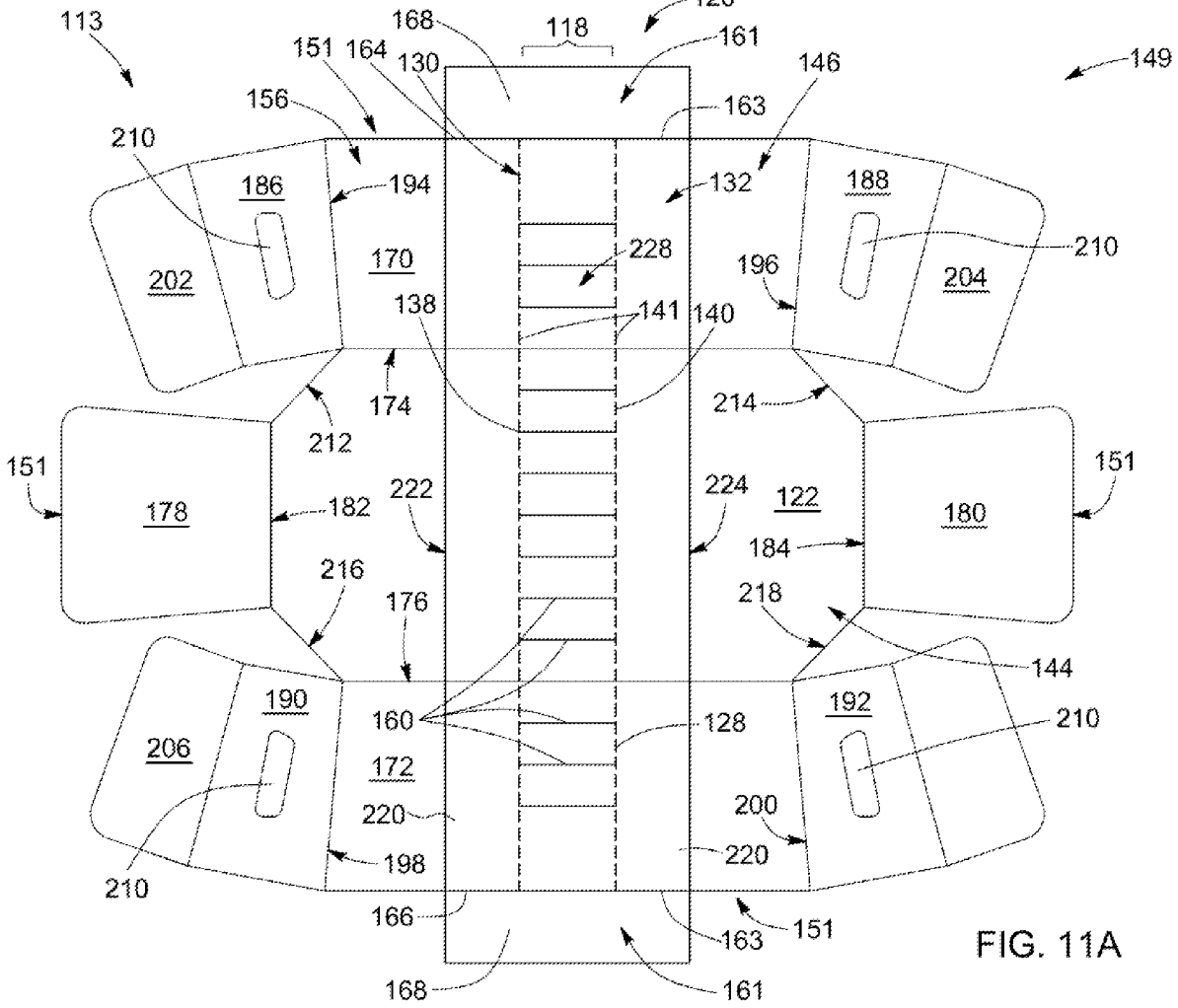
FIG. 11A is a top plan view of a blank for making the basket assembly shown in FIG. 8, the blank having a container portion and a support sheet, the top plan view showing an inner side of the container portion.
Figure 11C:
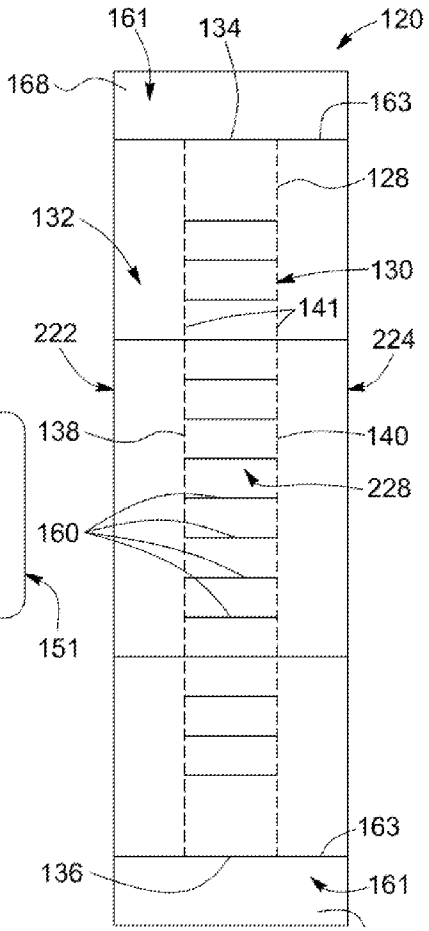
FIG. 11C is a top plan view of the support sheet of the blank shown in FIG. 11A, showing an inner side of the support sheet.
Figure 11B:
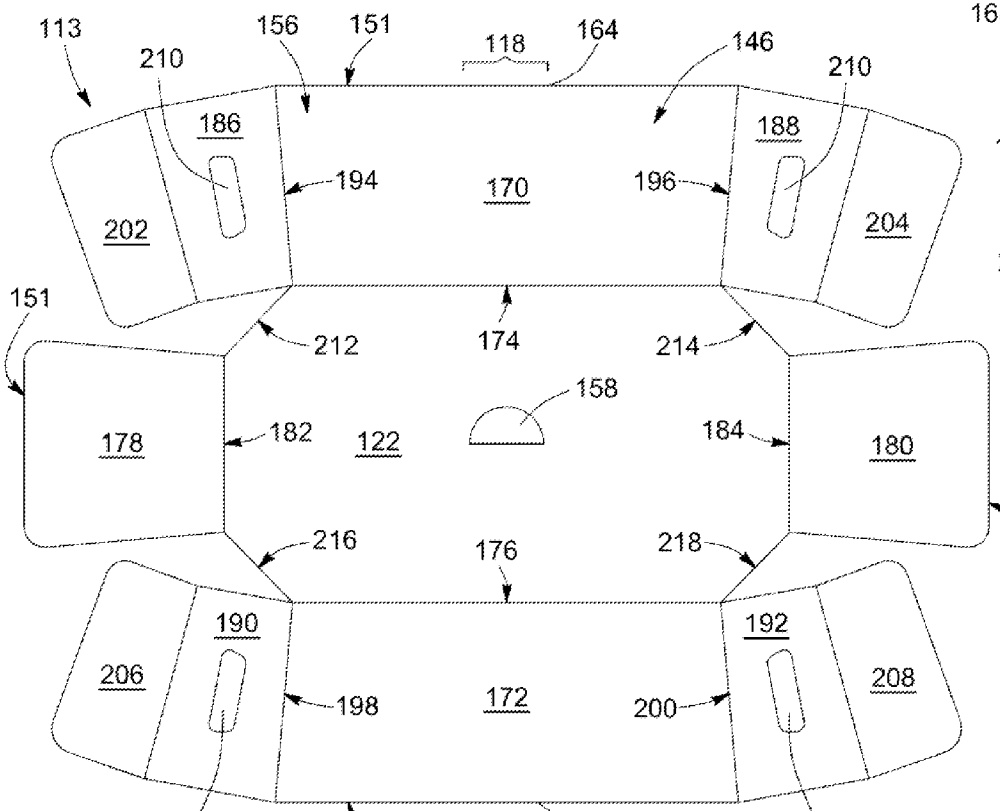
FIG. 11B is a top plan view of the container portion of the blank shown in FIG. 11A, showing the inner side of the container portion.

In accordance with the third embodiment, wherein the support sheet is mounted inside the container, as better illustrated in FIGS. 9 and 11B, an outermost layer (156) of the multi-layered assembly (124), i.e. the container (114), comprises a push hole (158) under the handle portion (128), to allow lifting the handle portion (128) away from the bottom wall (122) of the container (114), and thereby facilitate operating the handle portion (128) toward the drawn-out configuration shown in FIG. 10.

In each of the first, second and third embodiments, the handle portion (128) further comprises articulating fold lines (160) in order to articulate the handle portion (128), as better illustrated in FIGS. 1 to 3, 4A, 4B and 5A to 5B for the first embodiment, in FIG. 7 for the second embodiment and in FIGS. 8, 10, 11A and 11C for the third embodiment. The articulating fold lines (160) a preferably spread evenly along the length of the handle portion (128). Each articulating fold line (160) extends from one (138) of the side edges of the handle portion (128) to the other one (140) of the side edges, in order to articulate the handle portion (128) and facilitate operation between the nested configuration (see FIGS. 1 and 8 for the first and second embodiment, respectively) and the drawn-out configuration (see FIGS. 2, 7 and 10, for the first, second and third embodiments, respectively). The articulations (i.e. segments between the foldlines) further provides the handle portion (128) with an arched profile when it is lifted-out into its drawn-out configuration. Indeed, as the handle portion (128) is folded between the side walls (170, 172) and the bottom wall (122) in its nested configuration, the handle portion (128) tends to be square-shaped. Thus, the fold lines (160) may be particularly advantageous when the handle portion (128) is made of a relatively rigid material.

In accordance with an alternative embodiment the fold lines (160) or a portion thereof extend across a portion between the side edges (138, 140), i.e. they do not fully extend across the handle portion (128). It is to be understood also that the articulating fold lines (160) may be optional, provided that the handle portion (128) is sufficiently flexible to operate between the nested and drawn-out configurations.

In each of the above-mentioned embodiments, a handle support (161) is provided for connecting each of the opposing ends (134, 136) of the handle portion (128) to the container (114). The handle support (161) is provided by a flap (162, 168) extending from the innermost layer (132) and projecting beyond each of the opposing ends (134, 136) of the handle portion (128), as illustrated in FIGS. 1 to 3 and 5D for the first embodiment, in FIG. 7 for the second embodiment and in FIGS. 8 to 10 for the third embodiment. As also illustrated, each flap (162, 168) is foldable outwardly of the container (114) about an edge (164, 166) of the container (114) and mountable over a surface (165, 167) adjacent the corresponding edge (164, 166). The edges (164, 166) correspond to opposing sections of the rim (150) of the container (144) which intersect the inner lane (118). The flaps (162, 168) connect the handle portion (128) to the container (114). The flaps (162) are glued onto the support sheet (120) in the case of the first and second embodiments, as better illustrated in FIGS. 1 to 3 and 5D, and in FIG. 7, respectively. The flaps (168) are glued onto the container portion (114) in the case of the third embodiment, as better illustrated in FIGS. 8 to 10. Any suitable adhesive, such as hot melt glue, water based cold-set adhesive, and/or the like may be used in order to adhere the flaps (162, 168) over surfaces (165, 167), as well as any other suitable mounting means, such as a staple, a tape, a tab-lock system, etc. as will be easily understood by the person skilled in the art.

In the first embodiment, with reference to FIGS. 1 to 3, as for the second embodiment, with reference to FIG. 7, the innermost layer (132) is provided by the container (114), and the flaps (162) extend integrally from this container (114), at opposing portions (164, 166) of the rim (150), intersecting the inner lane (118). As can also be seen, each of the flaps (162) extends integrally from one of the ends (134, 136) of the handle portion (128). A fold line (163) delimits each of the flaps (162) from the innermost layer (132), i.e. from the container (114), as well as from the handle portion (128). The fold line (163) aligns with the rim (150) of the container (114).

In accordance with an alternative embodiment, the flap (162) may be a separate component which is mounted with the handle portion (128) and/or container (114).

In the third embodiment, the flaps (168) extend integrally from the support sheet (120), as better shown in FIGS. 8 to 10, which corresponds to the innermost layer (132). As can also be seen, each of the flaps (168) extends integrally from one of the ends (134, 136) of the handle portion (128). A fold line (163) delimits each of the flaps (168) from the innermost layer (132), i.e. from the support sheet (120), as well as from the handle portion (128). This fold line (163) aligns with the rim (150) of the container (114).

Advantageously, the flaps (162, 168) provide reinforcement to the connection between the handle (142) and the container (114), when the basket is used and the handle portion (128) is operated in the drawn-out configuration (see FIG. 2). The flap (162, 168) may be provided in any suitable size and shape. Moreover, the flap (162, 168) may be mounted on any suitable surface of the container (114) or of the support sheet (120) or any other component mounted on the container (114), preferably near the edges (164, 166) adjacent the inner lane (118), for ease of use of the handle (142) and for a better connection between the handle portion (128) and the container (114). Furthermore, any suitable adherent and/or fastening component or mechanism may be provided for suitably mounting the flaps (162, 168) over the surfaces (165, 167) adjacent respective edges (164, 166) of the container (114). The flaps (162, 168) are shaped and sized, and the adherent is applied in an amount and on a suitable surface area of the flap (162, 168) and/or of the surface (165, 167) adjacent edges (164, 166) in order to provide the handle (142) of the basket (112) with sufficient strength and tear-resistance to suitably hold the contents of the basket (112).

There is further provide a reinforcement strip (169) running across the handle portion (128) from one (134) of the opposing ends to the other one (136) of the opposing ends, and preferably extending onto the flaps (162), as can be seen in FIGS. 2, 3, 4B and 5A for the first embodiment and in FIG. 7 for the second embodiment, in order to reinforce the connection of the handle portion (128) with the container (114) of the basket (112), and increase tear-resistance of the handle (142) and/or connected component. Indeed, the joint between the handle (142) and the container (114), as well as the entire handle (142) may be stressed under the weight of the content of the basket container (114).

The reinforcement strip (169) preferably comprises a nylon-based material or the like, in order to increase the tear-resistance of the handle (142). The reinforcement strip is preferably a heat-sensitive nylon tape which is applied under heat to the container portion (113) of the blank (148) or the support sheet (120), by means of a corrugator. Thus, the basket assembly (110) comprises an adherent (220) for adhering the reinforcement strip (169) to the handle portion (128).

It is to be understood that the reinforcement strip (169) may be mounted on an upper surface (228) of the handle portion (128) (i.e. facing the containment area when the handle portion is in the nested configuration), as better illustrated in FIG. 6A where the reinforcement strip (169) has been adhered onto a surface of the blank (148) corresponding to the inner surface (146) of the container portion (113) of the blank (148). Alternatively, the reinforcement strip (169) may be mounted on a bottom surface (226) of the handle portion (128), as better illustrated in FIGS. 2 and 7, where the reinforcement strip (169) is adhered to a surface (144) of the container portion (113) opposite the inner surface (146). Alternatively or additionally, a reinforcement strip (169) may be provided in an intermediate layer of the handle portion. For example, the handle portion (128) may be made of two layers of material, sandwiching the reinforcement strip (169) with an adherent. It is to be understood also that the handle portion (128) may comprise more than two layers of material and a plurality of such intermediate reinforcement strips (169). It is to be understood also that any suitable adherent and/or mounting means may be used to mount the reinforcing strip (169) to the handle portion (128). Thus, one or more reinforcement strip (169) may be mounted on a bottom surface (226) of the handle portion (128), on an upper surface (228) of the handle portion (128); and/or between layers of the handle portion (228).

Though the reinforcement strip (169) is only illustrated for the first and second embodiment, the skilled person will understand that a basket (112) in accordance with the third embodiment described herein, as well as an associated blank and/or basket assembly, may also comprise a similar reinforcement strip (169) running across the handle portion (128).

It is to be understood also that the reinforcement strip (169) may be provided in segments of tape or the like, and that the reinforcement strip (169) may refer to any other similar strengthening and/or tear resistant component mountable to the handle portion (128).

Referring now to FIGS. 1, 7 and 8 for first, second and third embodiments, respectively, the container (114) comprises two side walls (170, 172) erected at opposing sides (174, 176) of the bottom wall (122). The inner lane (118) of the container (114) runs centrally across the two side walls (170, 172) and the bottom wall (122), as can be seen in the drawings. The container further comprises two end walls (178, 180) erected at opposing ends (182, 184) of the bottom wall (122) and four corner walls (186, 188, 190, 192) for joining adjacent pairs (170 and 180, 172 and 180, 172 and 178, and 170 and 178) of the side and end walls. The side walls (170, 172) are longer than the end walls (178, 180).

The support sheet (120) is rectangular and is mounted on the bottom wall (122) and two side walls (170, 172) of the container (114), in alignment with the inner lane (118) of the container (114). Thus, the basket assembly (110) includes an adherent (220) to adhere edges (222, 224) of the support sheet (120) to the container (114).

It is to be understood that in accordance with alternative embodiments, any of the walls may be curved or non-planar.

Still alternatively, the container (114) may be substantially rectangular, having four (4) walls. Still alternatively, the container (114) may be provided by a single panel being curved in a U-shape, providing an area corresponding to a bottom wall and two opposing areas corresponding to side walls. It is to be understood also that the container (114) and/or container portion (113) may also be provided by a plurality of panels or similar components, as can be understood by the person skilled in the art.

Referring now to the blanks (148) shown in FIG. 4A for the first and second embodiment and to the blank (149) shown in FIG. 11A for the third embodiment, the corner walls (186, 188, 190, 192) extend on opposing ends (194, 196, 198, 200) of each of the side walls (170, 172). There is further provided a tongue (202, 204, 206, 208) projecting from each of the corner walls (194, 196, 198, 200) opposite the corresponding one of the side walls (170, 172). Each tongue (202, 204, 206, 208) is mounted to an adjacent one of the end walls (178, 180), preferably with an adhesive. Each tongue (202, 204, 206, 208) is configured, shaped and sized to overlap half of a corresponding end wall (178, 180), on an inner side (146) of the end wall (178, 180). Each of the corner walls (186, 188, 190, 192) comprises an air hole (210). As illustrated, the opposing sides (174, 176) of the bottom wall (122) extend between the ends (182, 184) and angular sides (212, 214, 216 and 218) join respective pairs (174 and 182, 174 and 184, 176 and 184, and 176 and 182) of sides and ends of the bottom wall (122) in alignment with the corner walls (194, 196, 198, 200).

It is to be understood that one or more air hole(s) (210) may be provided in any suitable number, as well as in any suitable shape and size, and on any of the walls (upright or bottom) of the container (114), as can be easily understood, depending on the shape of the container and the size of the items it is meant to contain. Indeed, the container (114) preferably comprises one or more air hole (210).

The support sheet (120), as better illustrated in FIG. 4C, is rectangular, preferably a rectangular shape, and is mounted on the bottom wall (122) and two side walls (170, 172) of the container (114), in alignment with the inner lane (118) of the container (114) and, substantially covering the handle portion (128), as well as the finger holes (152, 154). An adherent (220) is applied on the container (114), as better shown in FIG. 4B, and/or on the support sheet (120), in order to adhere edges (222, 224) of the support sheet (120) onto the container (114), and thereby obtain the assembled blank (148) shown in FIG. 4A.

Alternatively, the section (126) covered by the support sheet (120) may be limited to a portion of the handle portion (128). In such an embodiment, the raising of the handle portion (128) toward the drawn-out configuration may leave an opening in the basket (112). Such an opening may serve as an air hole, for example. Still according to an alternative embodiment, a plurality of support sheets (120) may be mounted on the container portion (113) along the inner lane (118) to form the multi-layered assembly (124).

Preferably, the container (114) is shaped to nest into another container (114) made from a similar basket assembly (110), when the handle portion (128) is operated in the nested configuration.

FIG. 5A to 5D show steps for making the blank (148) shown in FIG. 4A. Broadly described, a container portion (113) must be configured to be operable from a planar configuration to an assembled configuration to provide the above-mentioned container (114) for a basket (112). The support sheet (120) is further mounted on the container portion (113) to cover the bottom wall (122) of the container (114), so as to provide a multi-layered assembly (124) spanning over a section (126) of the inner lane (118). A handle is further defined from a cut-out portion (130) of an innermost layer (132) of the multi-layered assembly (124) within the inner lane (118), such that the handle portion (128) the side edges (138, 140) of the handle portion (128) are separable from the innermost layer (132). It is to be understood that the configuring of the container portion (113) may be done after or during the other steps (of mounting the support sheet (120) and defining the handle support (128))

Figure 5A:
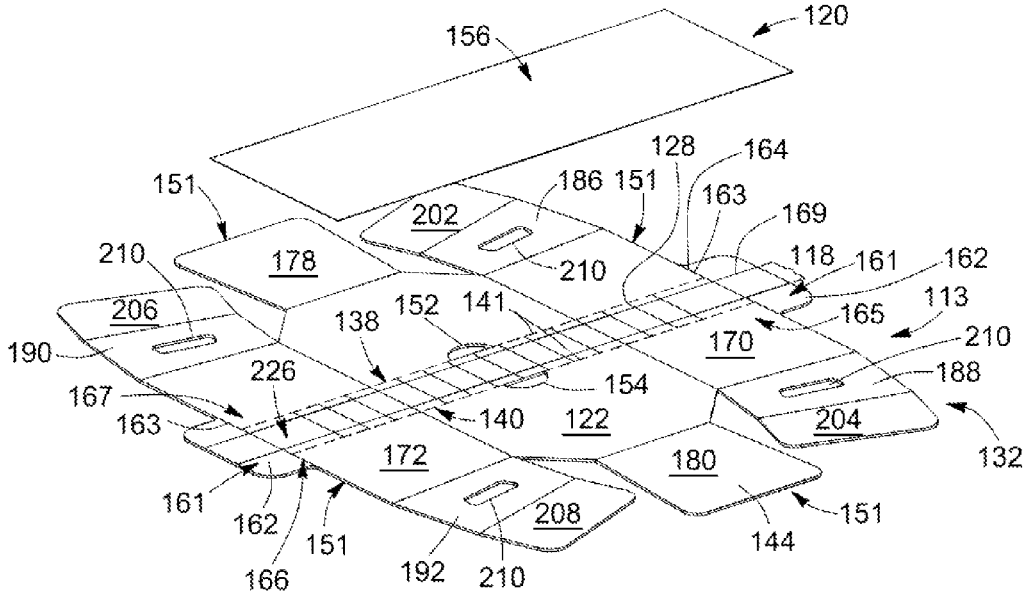
FIG. 5A is an exploded bottom perspective view of the blank shown in FIG. 4A, in accordance with a step of a method of assembling the blank.

More particularly, the container portion (113) is cut in accordance with the outline of the blank (148) shown in FIG. 5A. In this embodiment, the container portion (113) will correspond to the innermost layer (132). Perforation lines (141) are made within the inner lane (118), thereby defining the side edges (138, 140) of the handle portion (128), in order to detacheably connect the side edges (138, 140) to the container portion (113), i.e. the innermost layer (132) of the multi-layered assembly (124). In an alternative embodiment a cut line or partial cut line(s) may be made along the side edges (138, 140). Further a finger hole (152, 154) is cut in the container portion (113) in a semi-circular shape, i.e. the innermost layer (132), adjacent the handle portion (128), along each of the side edges (138, 140) to allow gripping the handle portion (128) toward the drawn-out configuration. The handle portion (128) is shaped in order for the ends (138, 140) to coincide with opposing rim portions (151) of the container portion (113), which correspond to a rim (150) of the container when the container portion (113) is operated in the assembled configuration.

The container portion (113) is cut to provide flaps (162) projecting beyond each of the opposing ends (134, 136) of the handle portion, thereby connecting the handle portion (128) to the container portion (113).

A reinforcement strip (169) is adhere to the handle portion (128) on an under surface (226), extending from one (134) of the opposing ends to the other one (136) of the opposing ends, and further covering the flaps (162) beyond the ends (134, 136) of the handle portion (128).

Articulating fold lines (160) are then formed in the handle portion (128). Each articulating fold line (160) extends from one (138) of the side edges to the other one (140) of the side edges, in order to articulate the handle portion (128) and facilitate operation between the nested and drawn-out configurations.

Fold lines are formed at opposing sides (174, 176) of the bottom wall (122) in order to define two side walls (170, 172) erectable at said opposing sides (174, 176) of the bottom wall (122), the afore-mentioned inner lane (118) of the container portion (113) extending across the two side walls (170, 172) and the bottom wall (122). Further, fold lines are formed at opposing ends (182, 184) of the bottom wall (122) delimiting two end walls (178, 180) erectable at said opposing ends (182, 184) of the bottom wall (122). Four corner walls (186, 188, 190, 192) are then defined on the container portion (113) for joining adjacent pairs of the side (170, 172) and end (178, 180) walls. Additionally, a fold line is formed along opposing ends (194, 196, 198, 200) of each side wall (170, 172) to delimit two of the corner walls (186, 188, 190, 192) for each side wall (170, 172). A fold line is further made along an edge of each corner wall (186, 188, 190, 192), opposite the corresponding side wall (170, 172), thereby defining a tongue (202, 204, 206, 208) projecting from each of the corner walls (186, 188, 190, 192). Each tongue (202, 204, 206, 208) being mountable to an adjacent one of the end walls (178, 180).

Air holes (210) are cut in the container portion (113), namely one air hole (210) is provided on each of the corner walls (186, 188, 190, 192).

As shown in FIG. 5A, the support sheet (120) is positioned over the outer surface (144) of the container portion (113), in alignment with the inner lane (118) and spanning over the bottom wall (122) and the two side walls (170, 172) of the container portion (113).

Figure 5B:
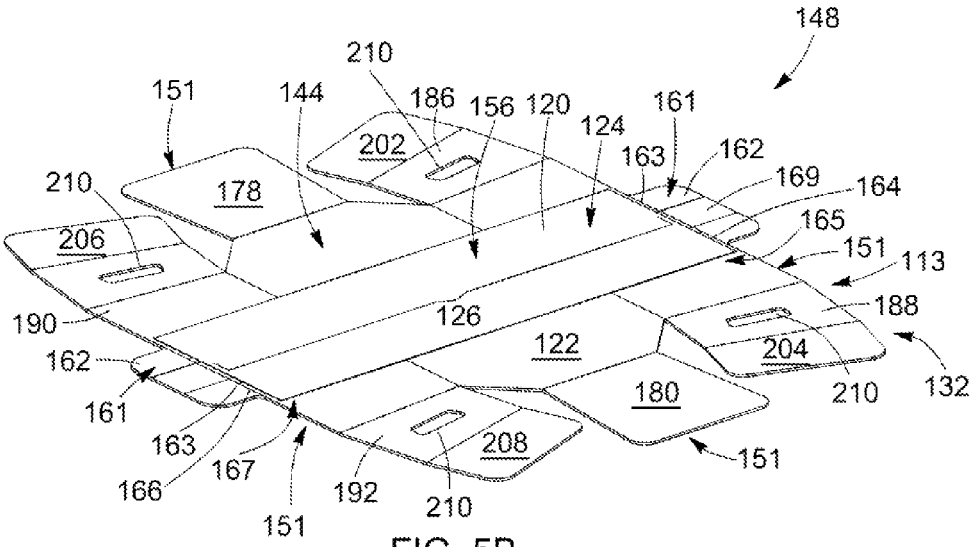
FIG. 5B is a bottom perspective view of the blank shown in FIG. 5A, showing the support sheet being mounted on an outer side of the container portion, in accordance with another step of the method of assembling the blank.

At FIG. 5B, the support sheet (120) is adhered to the container portion (113), substantially covering the handle portion (128). Preferably, the edges (222, 224) of the support sheet (120) are adhered to the container portion (113), as better illustrated in FIG. 4A to 4C.

Figure 5C:
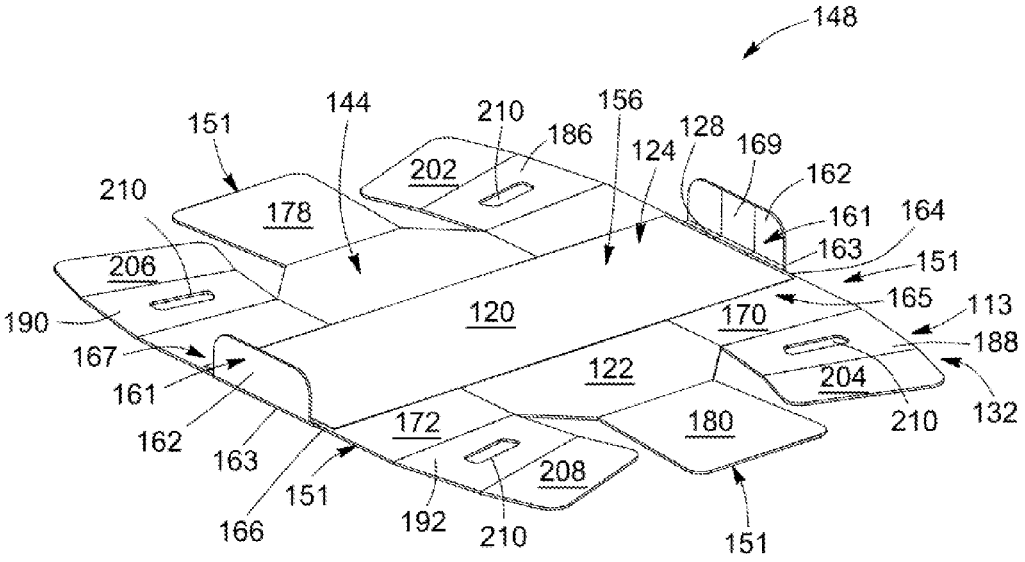
FIG. 5C is a bottom perspective view of the blank shown in FIG. 5B, showing flaps of the container portion being folded outwardly, in accordance with another step of the method of assembling the blank.

At FIG. 5C, the flaps (162) are folded outwardly i.e. toward the outer surface (144), about the opposing edges (164, 166) of the container portion (113).

Figure 5D:
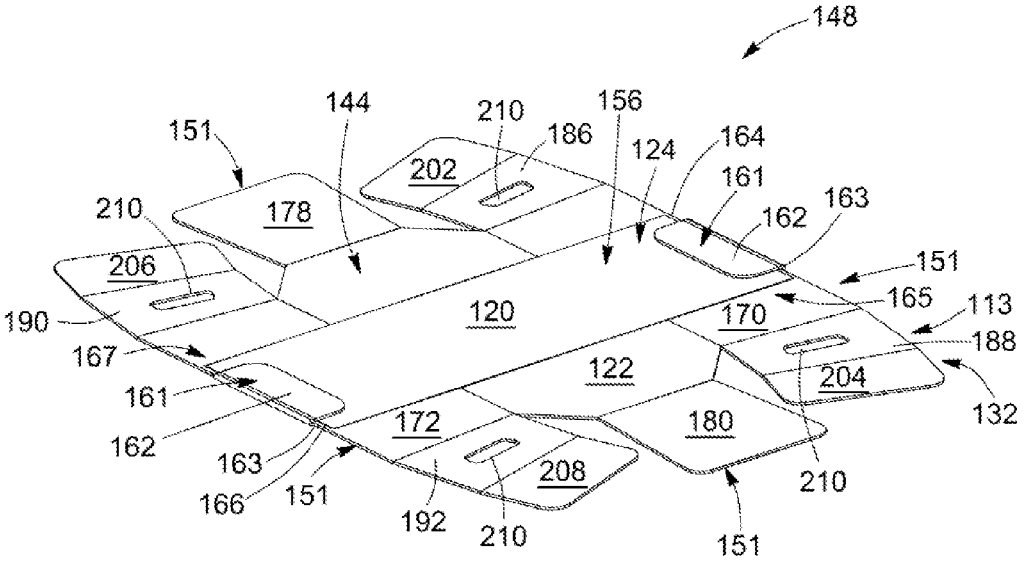
FIG. 5D is a bottom perspective view of the blank shown in FIG. 5C, the flaps being shown folded and glued to the inner surface of the container portion, in accordance with yet another step of the method of assembling the blank.

At FIG. 5D, the flaps (162) are further folded and adhered onto the support sheet (120), over surfaces (165, 167) adjacent the edges (164, 166) of the container portion (113).

The container portion (113) is configured to provide, when in the assembled configuration (as better shown in FIG. 1), a container (114) shaped to nest into another container (114) assembled from a similar blank (148, 149), when the handle portion (128) is operated in the nested configuration.

The above described steps of assembling the blank (148) also apply for the basket assembly in accordance with the second embodiment shown in FIG. 7.

In the alternate third embodiment shown in FIGS. 8 to 11C, the method of making the blank (149) includes cutting the container portion (113) in accordance with the outline of the blank shown in FIG. 11B, including cutting a push hole (158) in the container portion (113). The method further includes cutting the support sheet (120) as shown in FIG. 11C, and defining the handle portion (128) on the support sheet (120), as also shown. Thus, the reinforcement strip (169) is mounted on the support sheet (120), i.e. over the handle. Also, the perforation lines (141) and the articulating fold lines (160) are formed on the support sheet in which the handle portion (128) is delimited.

Still, in the method of making the blank (149) of the third embodiment, the support sheet (120) is cut and configured to provide flaps (168) extending beyond the ends (138, 140) of the handle portion (128), as can be seen in FIG. 11C. Further, the method includes mounting the support sheet (120) on an inner surface (146) of the container portion (113). The flaps (168) are then folded about the respective edges (164, 166) toward the outer surface (144) of the container portion (113). The flaps (168) are then mounted onto the outer surface (144) of the container portion (113), adjacent the respective edges (164, 166). The other steps for making the blank are similar to those of the first and second embodiments.

With reference to FIG. 6A to 6C, the support sheet is preferably of a rectangular shape extending fully across the bottom wall and both side walls. In this particular embodiment, the support sheet is preferably no narrower than the one shown in FIG. 6B in order to cover the handle portion and the finger holes (152, 154) shown in FIG. 6A. Furthermore, the support sheet is preferably no broader than the one shown in FIG. 6C, in this particular embodiment, in order to fit within the boundaries of the opposing side walls (170, 172) shown in FIG. 6A. The support sheet (120) substantially covers the length of the handle portion (128), i.e. section (126) of the inner lane (118), as better represented in FIG. 4A.

In an alternative embodiment, the support sheet (120) does not cover or does not entirely cover the finger holes (152, 154). In such an embodiment, the support sheet (120) may be narrower than the one shown in FIG. 6A. Still alternatively, the support sheet (120) may have relatively narrow ends with a wider portion toward the center in order to reduce the amount of material and still cover or substantially cover the finger holes (152, 154). In yet another alternative embodiment, where the finger holes (152, 154) are absent, smaller, narrower or positioned on a single side of the handle portion, the support sheet (120) may be narrower than the one shown in FIG. 6A.

It is to be understood also that in accordance with an alternative embodiment, the support sheet may be sized larger and/or broader than the one shown in FIG. 6C. Indeed, the support sheet may be sized and shaped to extend onto the end walls (178, 180). The support sheet may even extend beyond the outer sides of the side (170, 172) and/or end walls (178, 180) and further line the interior side of the basket.

It is to be understood that the support sheet (120) may have any suitable size and shape to be superposed with respect to the container (114) an provide the above-mentioned multi-layered assembly (124). In the case where the support sheet (120) is mounted inside the container (114) and provides the handle (128) for the basket (112), the support sheet (120) preferably extends beyond the handle portion (128) to have a surface area for mounting the handle portion (128) to the container (114). In the case where the support sheet (120) is mounted on the exterior of the container (114) and substantially covers the gap (115) left by the handle portion (128) when it is drawn out, the support sheet (120) substantially overlaps the handle portion (128) and overlaps part of the container (114), in order to mount the handle portion (128) to the container (114). Furthermore, the support sheet (120) may be mounted to the container (114) with any suitable mounting means, such as for example an adherent, a staple, an adhesive tape, and tab lock and slot system (where one or more tab locks are made integral with the support sheet (120) and/or the container (114) and interlock with a matching slot provided in the other one of the support sheet (120) and container (114)), and/or the like. Preferably, the area of the multi-layered assembly (124) corresponding to the handle portion (128) does not have any adhesive between the handle portion (128) and the rest of the multi-layered assembly (124).

As previously mentioned, FIG. 7 shows a second embodiment, which is very similar to the first embodiment, illustrated in FIGS. 1 to 5D, with the exception that the support sheet (120) is made of a translucent material (121), namely a translucid plastic film, which provides a window (123) in the gap (115) left by the handle portion (128) when it is raised away from its nested configuration. Variants of this embodiment include a support sheet comprising a translucent paper. The window (123) may be clear and transparent or it may be light diffusive.

As previously mentioned, FIGS. 8 to 11C show a third embodiment, wherein the support sheet (120) is mounted to be provided inside the container (114) and to have the handle portion (128) cut-out from the support sheet (120), i.e. the innermost layer (132). In FIG. 8, the basket assembly has a handle portion (128) configured in a nested configuration. In FIG. 9, the handle portion (128) is operated in the drawn-out configuration. In FIG. 10, shows basket of FIG. 9 from a bottom perspective. The blank (149) for assembling the basket assembly of FIGS. 8 to 10, as illustrated in FIG. 11A. As can be seen, the support sheet (120) is mounted on an inner surface (146) of the container portion (113). The unassembled container portion (113) and support sheet (120) are illustrated separately in FIGS. 11B and 11C, respectively.

In order to assemble the blank (148, 149) to form the above-described basket assembly (110), illustrated in FIGS. 1, 7 and 8, the side walls (170, 172) are folded about the opposing sides (134, 136) of the bottom wall (122), toward an erected configuration providing with side walls (170, 172) for the container (114) of the basket assembly (110). The end walls (178, 180) are also folded about the ends (182, 184) of the bottom wall (122), toward an erected configuration providing the container (114) with end walls (182, 184). Adjacent pairs of the side (170, 172) and end (178, 180) walls are joined with the corner walls (202, 204, 206, 208). Furthermore, each tongue (202, 204, 206, 208) is secured to an adjacent one of the end walls (178, 180).

In order to make a basket (112), as exemplified in FIGS. 2, 7 and 9, from the above-described basket assembly (110), the side edges (138, 140) of the handle portion (128) which are nested in the container (114), namely within the multi-layered assembly (124), are separated from the innermost layer (132), i.e. from the container portion (113) in the case of the first and second embodiments shown in FIGS. 2 and 7, respectively, or from the support sheet (120) in the case of the third embodiment shown in FIG. 9. Namely, the perforation lines (141) provided on the side edges (138, 140) of the handle portion (128) are severed by lifting the side edges (138, 140) away from this innermost layer (132), thereby operating the handle portion (128) toward a drawn-out configuration and providing the container (114) of the basket (112) with a handle (128).

It is to be understood that the basket assembly and/or blank for making the basket assembly, and/or components thereof, may be made of any suitable material, including corrugated containerboard, folding carton, molded pulp or other cellulose fiber material or even a plastic material, etc. Preferably, the container, handle and support sheet are made of a same or similar recyclable material to allow easier disposal. It is to be understood also that any of the components of the basket, basket assembly or blank, in accordance with the present invention, including the container, container portion, handle portion and support sheet may be made of a multi-layered material, a laminated material, etc. and that each component may be made from an assembly of materials (for example a plastic film adhered to a paper sheet, etc.). Furthermore, the components of the basket assembly and/or blank for making the basket assembly may comprise water-proof, water repellent or water resistant material (for example, by use of a coating, a chemical treatement, etc.).

Alternatively, the basket assembly, blank and/or components thereof include any other material allowing the container to hold content and allowing the handle to support the container, and further allowing the handle to operate between the nested and drawn-out configurations. For example, the container portion and/or handle portion may be made of or comprise a plastic material (a plastic sheet, a corrugated plastic, or the like).

The container (114) is preferably shaped to nest into another container made from a similar basket assembly, when the handle portion is operated in the nested configuration, in order to allow stacking a plurality of basket assemblies for easier shipping and/or storage. The containment area preferably widens from the bottom wall toward the upper portion to allow nesting a plurality of similarly shaped and sized basket assemblies. This may be achieved by providing the walls to be erected about the bottom with a shape which widens from the bottom wall toward the upper portion of the containment area.

Embodiments of the present invention are advantageous in that the basket assembly is provided with an integral handle and is therefore readily mountable into a fully assembled basket, without requiring to add a separately provided handle to the container of the basket, nor to assemble the container.

Still advantageously, the multi-layered assembly substantially covers the gap formed by the handle when it is lifted, thereby substantially enclosing the containment area of the basket's container, and reducing loss of the contents of the basket. As a further advantage of the multi-layered assembly, the handle may be relatively wide, since the lifting of the handle portion is prevented from creating a large hole through the basket.

According to embodiments of the present invention, the basket assembly may be nested into another similar basket assembly, when the handle in the nested configuration, for efficient shipping and/or storage.

Moreover, the basket made from a basket assembly and/or blank according to embodiments of the present invention, may be easily and safely disposed of for recycling or composting, without requiring the basket to be disassembled.

Furthermore, according to embodiments of the present invention, the handle is easily operated between the drawn-out and nested configurations, without being constrained by the structure forming and holding the container. Indeed, the handle's operation is independent from the structure of the container, allowing the pre-assembled basket to have a drawn-out handle ready for use or a nested handle for shipping, storage, etc.

A further advantage of embodiments of the present invention, concerns the connection of the handle to the rim area of the container, which replicates the configuration of a conventional basket and allows easier and more intuitive handling of the basket and its contents.

Numerous modifications could be made to the above-described package with integral markers, without departing from the scope of the present invention. Indeed and for example, it is to be understood that the container may be provided with any suitable shape, and may comprises any suitable number of wall panels. The container may be shaped with four walls for example, instead of eight. Further the walls of the container may extend substantially perpendicularly above the bottom wall. Still alternatively, the container may be provided with a cover or a component substantially covering the upper opening. Still alternatively, the container may have the shape of a shallow tray provided by an arched panel. Still alternatively, the container may be U-shaped or V-shaped. Still alternatively, the container may have a cylindrically shaped wall or the like.

It is to be understood also that in accordance with alternative embodiments, the support sheet may cover only a portion of the side walls or depending on the particular shape of the container, it may extend along a portion of the containment area or a portion of the bottom wall. Indeed, it is to be understood that the support sheet may have any suitable shape, depending on the particular shape of the container.

Still, in another alternative embodiment, the container (114) is substantially rigid, for example made from molded pulp, plastic and/or the like, to which a support sheet is mounted. That is to say, the components of the basket or basket assembly in accordance with the present invention, are not necessarily collapsible or flexible nor do they necessarily result from an assembled blank.

Furthermore, in accordance with alternative embodiments of the present invention, the handle may extends beyond the area of the basket that is multi-layered, so long as a hole appearing in the basket when the handle is drawn out, is sufficiently small to minimize content of the basket from dropping through this hole.

It is to be understood also that although the basket described herein provides an improvement over existing baskets generally used for food shipment and sale in markets, the basket, the basket assembly and the blank, as well as the associated methods are intended to provide baskets for a variety of other uses, content and product sales, as can be easily understood by a person skilled in the art.

Numerous modifications could be made to the above-described package with integral markers, without departing from the scope of the present invention. The above-described embodiments are considered in all respect only as illustrative and not restrictive, and the present application is intended to cover any adaptations or variations thereof, as apparent to a person skilled in the art.

The invention claimed is:

1. A basket assembly for making a basket, the basket assembly comprising:

a container having a bottom wall, a containment area, and an inner lane extending across the containment area of the container;

a support sheet mountable along the bottom wall of the container so as to provide a multi-layered assembly spanning over a section of the inner lane; and a handle portion extending within the inner lane and being defined from a cut-out portion of an innermost layer of the multi-layered assembly, the handle portion having a pair of opposing ends mountable to the container and a pair of side edges extending between the opposing ends, the side edges being separable from the innermost layer in order to operate the handle portion between a nested configuration wherein the handle portion is substantially nested within the multi-layered assembly, and a drawn-out configuration wherein the side edges of the handle portion are drawn away from said multi-layered assembly to provide the container of the basket with a handle.

2. The basket assembly according to claim 1, wherein the container comprises an outer surface and the support sheet is mounted on said outer surface, the innermost layer being provided by the container.

3. The basket assembly according to claim 1, wherein the container comprises an inner surface and the support sheet is mounted on said inner surface, the innermost layer being provided by the support sheet.

4. The basket assembly according to claim 1, wherein the opposing ends of the handle portion coincide with a rim of the container.

5. The basket assembly according claim 1, wherein the handle portion is delimited along each of the side edges by a perforation line detachably connecting the side edges to the innermost layer of the multi-layered assembly.

6. The basket assembly according to claim 1, wherein the handle portion is cut from the innermost layer, along each of the side edges.

7. The basket assembly according to claim 1, wherein the innermost layer of the multi-layered assembly comprises a finger hole adjacent the handle portion, along at least one of the side edges to allow gripping the handle portion toward the drawn-out configuration.

8. The basket assembly according to claim 1, wherein an outermost layer of the multi-layered assembly comprises a push hole under the handle portion, to allow lifting the handle portion away from the bottom wall of the container.

9. The basket assembly according to claim 1, wherein the handle portion further comprises articulating fold lines, each articulating fold line extending from one of the side edges to the other one of the side edges, in order to articulate the handle portion and facilitate operation between the nested and drawn-out configurations.

10. The basket assembly according to claim 1, further comprising a handle support for connecting each of the opposing ends of the handle portion to the container.

11. The basket assembly according to claim 10, wherein the handle support comprises a flap extending from the innermost layer and projecting beyond each of the opposing ends of the handle portion, each flap being foldable outwardly of the container about an edge of the container and mountable over a surface adjacent the corresponding edge.

12. The basket assembly according to claim 1, wherein the container comprises two side walls erectable at opposing sides of the bottom wall, the inner lane of the container running across the two side walls and the bottom wall.

13. The basket assembly according to claim 12, further comprising an adherent to adhere edges of the support sheet to the container.

14. The basket assembly according to claim 12, wherein the container further comprises two end walls erectable at opposing ends of the bottom wall and four corner walls for joining adjacent pairs of the side and end walls.

15. The basket assembly according to claim 14, wherein two of the corner walls extend on opposing ends of each side wall, the basket assembly further comprising a tongue projecting from each of the corner walls opposite the side wall, each tongue being mountable to an adjacent one of the end walls.

16. The basket assembly according to claim 14, wherein each of the corner walls comprises an air hole.

17. The basket assembly according to claim 1, wherein the container is shaped to nest into another container made from a similar basket assembly, when the handle portion is operated in the nested configuration.

18. The basket assembly according to claim 1, wherein the support sheet comprises a translucent material.

19. A blank for making a basket assembly, the blank comprising:

a container portion being operable from a planar configuration wherein the container portion extends substantially along a given plane and an assembled configuration wherein the container portion is shaped and configured to provide a container for a basket, having a containment area, a bottom wall, and an inner lane extending across the containment area of the container;

a support sheet mountable on the container portion to cover the bottom wall of the container so as to provide a multi-layered assembly spanning over a section of the inner lane; and a handle portion extending within the inner lane and being defined from a cut-out portion of an innermost layer of the multi-layered assembly, the handle portion having a pair of opposing ends mountable to the container portion and a pair of side edges extending between the opposing ends, the side edges being separable from the innermost layer in order to operate the handle portion between a nested configuration wherein the handle portion is substantially nested within the multi-layered assembly, and a drawn-out configuration wherein the side edges of the handle portion are drawn away from said multi-layered assembly, when the container portion is operated in the assembled configuration, to provide the container of the basket with a handle.

20. The blank according to claim 19, wherein the container portion comprises an inner surface and wherein the support sheet is mounted on said inner surface, the innermost layer being provided by the support sheet.

21. The blank according to claim 19, wherein the container portion comprises a rim portion corresponding to a rim of the container when the container portion is configured in the assembled configuration, and wherein the opposing ends of the handle portion coincide with said rim portion.

22. The blank according to claim 19, wherein an outermost layer of the multi-layered assembly comprises a push hole under the handle portion, to allow lifting the handle portion away from the bottom wall of the container portion.

23. A basket assembly for making a basket, the basket assembly comprising:

a container having a bottom wall, a containment area, and an inner lane extending across the containment area of the container;

a support sheet mounted along the bottom wall of the container so as to provide a multi-layered assembly spanning over a section of the inner lane; and a handle portion extending within the inner lane and being defined from at least a portion of an innermost layer of the multi-layered assembly and extending integrally from said innermost layer, the handle portion having a pair of opposing ends mountable to the container and a pair of side edges extending between the opposing ends, the side edges being free in order to operate the handle portion between a nested configuration wherein the handle portion is substantially nested within the container, and a drawn-out configuration wherein the side edges of the handle portion are drawn away from said multi-layered assembly to provide the container of the basket with a handle.

24. A basket comprising:

a container having a bottom wall, a containment area, and an inner lane extending across the containment area of the container;

a support sheet mounted along the bottom wall of the container so as to provide a multi-layered assembly spanning over a section of the inner lane; and a handle extending in alignment with the inner lane and being defined from a cut-out portion of an innermost layer of the multi-layered assembly, the handle having a pair of opposing ends mounted to the container and a pair of side edges extending between the opposing ends, the side edges being separated from the innermost layer in order to operate the handle portion between a nested configuration wherein the handle portion is substantially nested within the multi-layered assembly, and a drawn-out configuration wherein the side edges of the handle portion are drawn away from said multi-layered assembly to provide the container of the basket with a handle.

* * * * *